US012201176B2

(12) United States Patent
Weber

(10) Patent No.: US 12,201,176 B2
(45) Date of Patent: Jan. 21, 2025

(54) AUXETIC CONVERSION OF FOAM FOR IMPACT ATTENUATION

(71) Applicant: Gentex Corporation, Simpson, PA (US)

(72) Inventor: John Weber, Clarks Summit, PA (US)

(73) Assignee: Gentex Corporation, Simpson, PA (US)

( * ) Notice: Subject to any disclaimer, the term of this patent is extended or adjusted under 35 U.S.C. 154(b) by 106 days.

(21) Appl. No.: 17/774,757

(22) PCT Filed: Dec. 18, 2020

(86) PCT No.: PCT/US2020/066023
§ 371 (c)(1),
(2) Date: May 5, 2022

(87) PCT Pub. No.: WO2021/127445
PCT Pub. Date: Jun. 24, 2021

(65) Prior Publication Data

US 2022/0369752 A1 Nov. 24, 2022

Related U.S. Application Data

(60) Provisional application No. 62/949,548, filed on Dec. 18, 2019.

(51) Int. Cl.
*A42B 3/12* (2006.01)

(52) U.S. Cl.
CPC ..... *A42B 3/12* (2013.01)

(58) Field of Classification Search
CPC ..... A42B 3/127; A42B 3/12; A63B 71/10
See application file for complete search history.

(56) References Cited

U.S. PATENT DOCUMENTS

| | | | | |
|---|---|---|---|---|
| 2,785,404 | A * | 3/1957 | Strohm | A42B 3/12 2/412 |
| 7,455,567 | B2 * | 11/2008 | Bentham | A41C 3/144 450/57 |
| 7,930,771 | B2 * | 4/2011 | Depreitere | A42B 3/124 2/410 |
| 9,629,397 | B2 * | 4/2017 | Toronjo | A41D 31/285 |
| 9,936,755 | B2 * | 4/2018 | Blakely | A43B 23/027 |
| 10,709,190 | B2 * | 7/2020 | Brachos | A42B 3/12 |

(Continued)

FOREIGN PATENT DOCUMENTS

WO 2019195339 A1 10/2019

OTHER PUBLICATIONS

International Search Report and Written Opinion for International Application No. PCT/US2020/066023 dated Apr. 20, 2021, 12 pages.

*Primary Examiner* — Katherine M Moran
(74) *Attorney, Agent, or Firm* — Morgan, Lewis & Bockius LLP

(57) ABSTRACT

An impact absorbing article including an auxetic foam substrate having a top surface, a bottom surface opposite the top surface, and a thickness extending from the top surface to the bottom surface. The auxetic foam substrate is comprised of a plurality of closed-cells and configured to dissipate forces delivered through the bottom surface associated with localized impacts delivered to the top surface of the auxetic foam substrate. The plurality of closed cells each have a negative Poisson ratio.

17 Claims, 15 Drawing Sheets

(56) References Cited

U.S. PATENT DOCUMENTS

| | | | | |
|---|---|---|---|---|
| 2006/0112477 | A1* | 6/2006 | Schneider | A42B 3/12 2/412 |
| 2008/0032598 | A1 | 2/2008 | Bentham et al. | |
| 2015/0047110 | A1* | 2/2015 | Chilson | A42B 3/281 29/283.5 |
| 2015/0223547 | A1 | 8/2015 | Wibby | |
| 2017/0273386 | A1 | 9/2017 | Kuo et al. | |
| 2019/0299560 | A1 | 10/2019 | Toronjo | |
| 2021/0204631 | A1* | 7/2021 | Pahlmeyer | A42B 3/20 |
| 2021/0289872 | A1* | 9/2021 | Fremont | A42B 3/125 |
| 2021/0378344 | A1* | 12/2021 | Abram | A42B 3/28 |
| 2022/0225720 | A1* | 7/2022 | Frieder, Jr. | A42B 3/128 |
| 2023/0000185 | A1* | 1/2023 | Snoke | A41D 13/015 |
| 2023/0010873 | A1* | 1/2023 | Storey | A42B 3/064 |

* cited by examiner

AUXETIC CONVERSION OF FOAM FOR IMPACT ATTENUATION

CROSS-REFERENCE TO RELATED APPLICATIONS

This application is a 371 of International Application No. PCT/US2020/066023 filed Dec. 18, 2020, which claims the benefit of U.S. Provisional Patent Application No. 62/949,548 filed Dec. 18, 2019 entitled "Auxetic Conversion of Polypropylene Foam For Helmet Impact Attenuation", which are incorporated by reference herein in their entirety.

TECHNICAL FIELD

The present disclosure relates generally to foamed materials, and more particularly to devices, systems, and methods of creating and utilizing auxetic foam articles.

BACKGROUND OF THE INVENTION

Impact absorbing articles, such as helmets, protect the user from a variety of impacts, including localized impacts (also known as blunt impacts). The performance of impact absorbing articles is limited, in part, by existing energy absorbing materials. Typically, these energy absorbing materials are made from manufactured foams having positive Poisson's ratios. To guard against blunt impacts, the current solution involves increasing a thickness of the energy absorbing materials, which requires a corresponding thickness increase of the impact absorbing articles. However, increasing the thickness of impact absorbing articles is not practical in many applications, as doing so can compromise other performance requirements of the impact absorbing articles (e.g., helmet weight and situational awareness). Additionally, increasing the size of, for example, a helmet is believed to increase a likelihood of traumatic brain injury due to the increased rotational inertia of the larger helmet system.

BRIEF SUMMARY OF THE INVENTION

In one embodiment, there is an impact absorbing article including an auxetic foam substrate having a top surface, a bottom surface opposite the top surface, and a thickness extending from the top surface to the bottom surface. In some embodiment, the auxetic foam substrate is comprised of a plurality of closed-cells and configured to dissipate forces delivered through the bottom surface associated with localized impacts delivered to the top surface of the auxetic foam substrate and the plurality of closed cells each have a negative Poisson ratio.

In some embodiments, the impact absorbing article further includes a helmet having a shell configured to receive a head of a user. The shell may have an inner surface and an outer surface, wherein the auxetic foam substrate is disposed on the inner surface of the shell.

In some embodiments, the auxetic foam substrate is configured to increase in density, temporarily, in response to the localized impact being delivered to the outer surface of the shell. The auxetic foam substrate may be configured to dissipate the forces associated with a predetermined localized impact delivered to the outer surface of the shell such that an amount of force transferred to the head of the user causes an acceleration of the head below 150 G.

In some embodiments, the auxetic foam substrate covers only a portion of the inner surface of the shell. The auxetic foam substrate may substantially cover the inner surface of the shell.

In some embodiments, a plurality of pads comprised of the auxetic foam substrate are distributed at multiple different locations on the inner surface of the shell, and the multiple different locations are selected based on locations of the head of the user that are vulnerable to localized impacts.

In some embodiments, The impact absorbing article further includes a padded layer comprised of a material disposed on the bottom surface of the auxetic foam substrate, the material of the padded layer being different than a material of the auxetic foam substrate, and a cover disposed over the padded layer and covering the padded layer and the auxetic foam substrate, wherein the auxetic foam substrate, the padded layer, and the cover form an impact absorbing pad.

In some embodiments, the impact absorbing article further includes a helmet shell configured to receive a head of a user, the helmet shell having an inner surface and an outer surface. One or more of the impact absorbing pads may be coupled to the inner surface of the helmet shell, approximately 2 inches or less thick, at least 2 inches long, and at least 2 inches wide, and configured to dissipate forces associated with localized impacts delivered to the outer surface of the helmet shell such that a peak acceleration below 250 G when the helmet shell is subjected to localized impacts of at least 25 J.

In some embodiments, the auxetic foam article is configured to dissipate forces associated with localized impacts delivered to the outer surface of the shell such that a peak acceleration below 200 G is maintained when the shell is subjected to localized impacts of at least 25 J.

In some embodiments, the auxetic foam article is configured to maintain a peak acceleration below 150 G when the shell is subjected to localized impacts of at least 25 J.

In some embodiments, the top surface of the auxetic foam substrate is an uneven surface comprised of a plurality of concave portions. The top surface of the auxetic foam substrate may have a convex curvature and the bottom surface of the auxetic foam substrate may have a concave curvature, the convex curvature of the top surface of the auxetic foam substrate and the concave curvature of the bottom surface of the auxetic foam substrate may be set when the auxetic foam substrate is formed.

In some embodiments, wherein the thickness of the auxetic foam substrate is between approximately 0.2 inches and approximately 2 inch.

In some embodiments, the auxetic foam substrate is comprised of polypropylene. In some embodiments, the auxetic foam substrate is comprised of polystyrene. The auxetic foam substrate may be isotropic foam.

In some embodiments, a density of the auxetic foam substrate is between approximately 1.0 lb/ft3 to approximately 10.0 lb/ft3.

Another embodiment of the present invention provides a method of making an auxetic foam article. The method includes providing a non-auxetic article comprised of a closed-cell foam, placing the non-auxetic article in an oven to prevent contact between the non-auxetic article and walls of the oven, heating the non-auxetic article placed within the oven for a first period of time, wherein the heating causes cells in the closed-cell foam of the non-auxetic article to soften, adjusting a pressure of the oven with the non-auxetic article placed therein for a second period of time, wherein adjusting the pressure causes the cells softened by the heating to at least partially collapse, which transforms the non-auxetic article into an auxetic foam article with a plurality of partially collapsed cells, and cooling the auxetic foam article for a third period of time.

In some embodiments, the non-auxetic article is one of polypropylene foam or polystyrene foam. The non-auxetic article may be comprised of one of expanded polypropylene (EPP) or expanded polystyrene (EPS).

In some embodiments, the non-auxetic article has a density between approximately 1.0 lb/ft3 to approximately 10.0 lb/ft3.

In some embodiments, adjusting the pressure of the oven comprises subjecting the non-auxetic article to a gauge pressure between approximately 0 kPa to approximately 100 kPa. adjusting the pressure of the oven may comprise subjecting the non-auxetic article to a vacuum pressure between approximately 0 kPa to approximately 101 kPa. Adjusting the pressure of the oven may comprise subjecting the non-auxetic article to a pressure greater than atmospheric pressure. Adjusting the pressure of the oven may comprise subjecting the non-auxetic article to a pressure between 100 kPa and 1 MPa.

In some embodiments, the cooling causes a structure of the plurality of partially collapsed cells of the auxetic foam article to become fixed.

In some embodiments, heating the oven comprises heating the non-auxetic article to a temperature between approximately 100° Celsius to approximately 220° Celsius. Heating the oven may comprise heating the non-auxetic article to a temperature between approximately 120° Celsius to approximately 140° Celsius.

In some embodiments, a density of the auxetic foam article is between 0% and 50% greater than the density of the non-auxetic article. A density of the auxetic foam article may be between 50% and 70% greater than the density of the non-auxetic article.

In some embodiments, pressurizing the oven comprises subjecting the non-auxetic article to a vacuum pressure and heating the oven comprises heating the non-auxetic article to an elevated temperature.

In some embodiments, the non-auxetic article undergoes an isotropic auxetic conversion when transformed into the auxetic foam article.

In some embodiments, the non-auxetic article has a predetermined softening temperature and heating the oven comprises heating the non-auxetic article to the predetermined softening temperature.

BRIEF DESCRIPTION OF THE DRAWINGS

So that the present disclosure can be understood in greater detail, a more particular description may be had by reference to the features of various embodiments, some of which are illustrated in the appended drawings. The appended drawings, however, merely illustrate pertinent features of the present disclosure and are therefore not to be considered limiting, for the description may admit to other effective features.

Figure 1A:
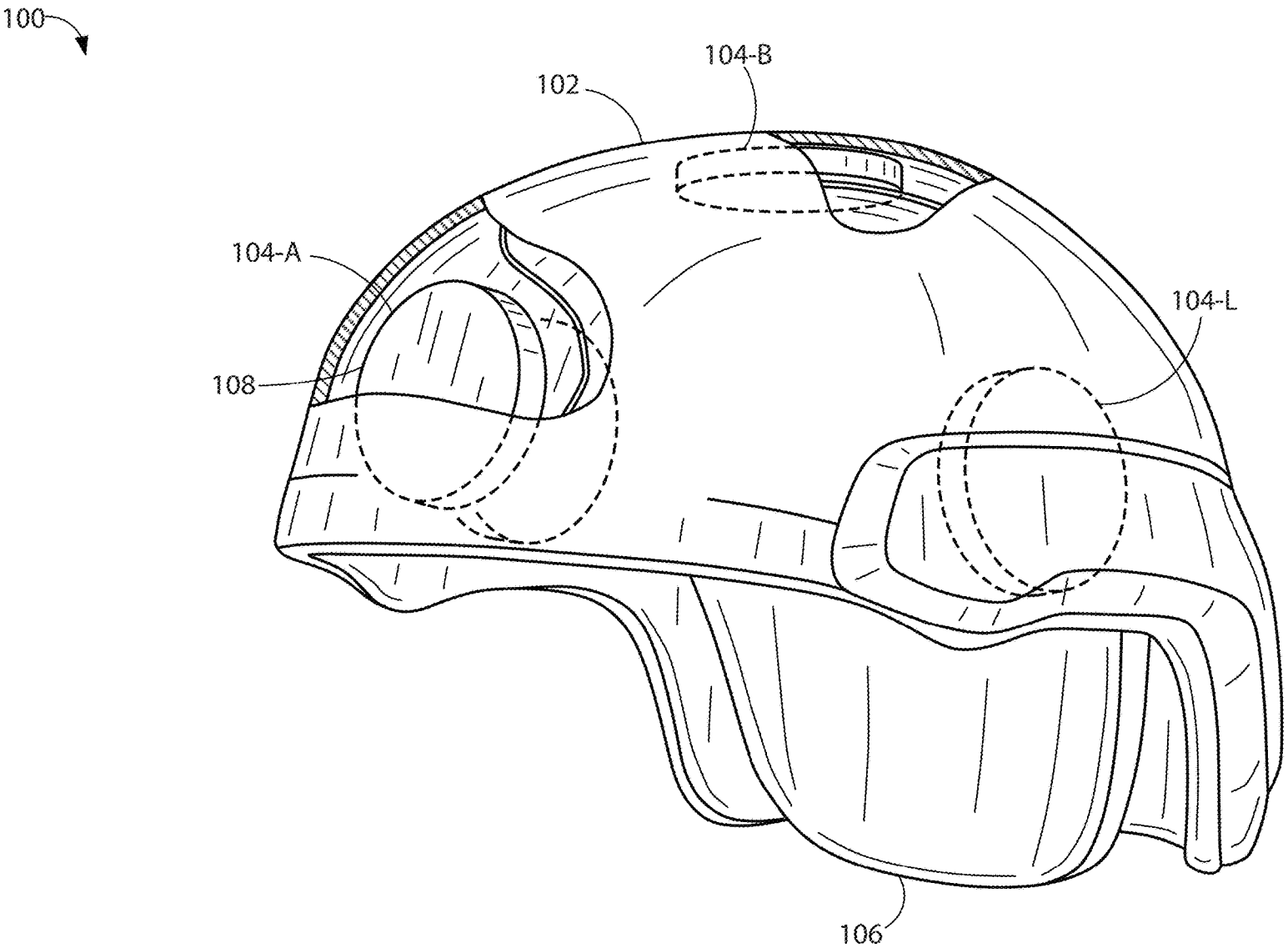
FIG. 1A is an oblique view of a helmet in accordance with a first exemplary embodiment.

In accordance with common practice, the various features illustrated in the drawings may not be drawn to scale. Accordingly, the dimensions of the various features may be arbitrarily expanded or reduced for clarity. In addition, some of the drawings may not depict all of the components of a given system, method or device. Finally, like reference numerals may be used to denote like features throughout the specification and figures.

DETAILED DESCRIPTION

Numerous details are described herein in order to provide a thorough understanding of the example embodiments illustrated in the accompanying drawings. However, some embodiments may be practiced without many of the specific details, and the scope of the claims is only limited by those features and aspects specifically recited in the claims. Furthermore, well-known processes, components, and materials have not been described in exhaustive detail so as not to unnecessarily obscure pertinent aspects of the embodiments described herein.

Impact absorbing materials and structures are used in a variety of environments and for various purposes including adventure, sporting, police and military purposes. For example, impact absorbing materials and structures are needed for a variety of applications such as dental, medical devices, automobiles, transportation, sporting goods, shoes, military equipment, packaging, playground equipment or any other application for providing attenuation of multiple impacts. For example, helmets may require the use of impact absorbing materials or structures since helmets provide protection against projectiles and blunt force impacts. Helmets typically include a helmet shell having a peripheral edge and a retention system (e.g., chinstrap) that may be attached to helmet shell. Helmets also typically include a liner system coupled to an inside surface of the helmet shell to provide a compressible material such as foam for comfort and impact energy absorption. The liner system may be composed of a single contiguous structure or multiple distinct structures either of which may or may not completely cover the inner surface of the helmet shell. The need for a comfortable liner with high impact attenuation is particularly important for defense forces, emergency responders, and industrial personnel operating in high performance environments, as well as individuals wearing helmets for extended periods of time under harsh conditions.

Referring to FIGS. 1A-3C wherein like reference numerals indicate like elements throughout, there is shown helmet 100, generally designated 100, in accordance with an exemplary embodiment of the present invention. In certain preferred embodiments of the present invention, helmet 100 includes shell 102, liner 108, and padding 106. In one embodiment, liner 108 may be used as a drop-in replacement for the impact liner of an existing helmet. In another embodiment, liner 108 may be used as a fully integrated system with the helmet.

FIG. 1A is an oblique view of an exemplary helmet 100 in accordance with some embodiments. The helmet 100 includes a shell 102, an impact absorbing liner 108, and padding 106. The impact absorbing liner 108 may be comprised of auxetic foam substrate or articles 104. In some embodiments, the auxetic foam articles 104 are comprised of closed-cell foam for increased impact attenuation. In some embodiments, the auxetic foam article 104 may include additional padding such as open-celled foam to provide increased comfort. For example, the auxetic foam article 104 comprised of closed-cell foam may form the base of a helmet liner, while an open-celled foam pad may be provided on top of the auxetic foam article 104 for contacting the user's head.

The auxetic foam articles 104 may be used in a variety of applications such as dental, medical devices, automobiles, transportation, sporting goods, shoes, military equipment, packaging, playground equipment, or any other application that requires attenuation of multiple impacts. In some embodiments, auxetic foam articles 104 are discrete articles. However, auxetic foam articles 104 may extend over the entire surface of the liner system.

It is noted that the helmet 100, and its various components, may not be drawn to scale and is just a single example of the use of the auxetic foam articles 104. In some embodiments, the auxetic foam articles 104 are used in a variety of applications such as dental, medical devices, automobiles, transportation, sporting goods, shoes, military equipment, packaging, playground equipment, or any other application that requires attenuation and energy absorption of multiple impact events. Moreover, while some example features are illustrated, various other features have not been illustrated for the sake of brevity and so as not to obscure pertinent aspects of the example implementations disclosed herein. Sections of the shell 102 have been removed in FIG. 1A for ease of illustrating the impact absorbing liner 108 and, in particular, the auxetic foam articles 104 therein.

In practice, the helmet 100 is used to protect the head of a person wearing the helmet 100. Specifically, the helmet 100 can be used to absorb and dissipate otherwise harmful energies from numerous impacts (e.g., impacts from falling, impacts from other helmets, impacts from munitions, etc.). As will be discussed in detail below, the helmet 100 includes multiple means (e.g., the shell 102, the impact absorbing liner 108 comprised of the auxetic foam articles 104) for absorbing and dissipating otherwise harmful energies and forces. Importantly, the helmet 100 may be used in a variety of different applications, and a design (i.e., an overall shape) of the helmet 100 shown in FIG. 1A is merely one possible design for the helmet 100. In one example, illustrated in FIG. 1A, the helmet 100 is designed for military applications. In certain embodiments, the helmet 100 is a standard infantry ballistic helmet, advanced combat helmet (ACH), enhanced combat helmet (ECH), or lightweight advanced combat helmet (LWACH). In other embodiments, helmet 100 may be a modular integrated communications helmet (MICH), a tactical ballistic helmet (TBH), a lightweight marine helmet, police general duty helmet, or a personnel armor system for ground troops (PASGT) helmet. In some embodiments, the helmet 100 is designed for sports applications (e.g., football, hockey, baseball, cycling, vehicle racing, etc.) or for other applications (e.g., firefighting, construction, police, etc.).

Figure 1B:
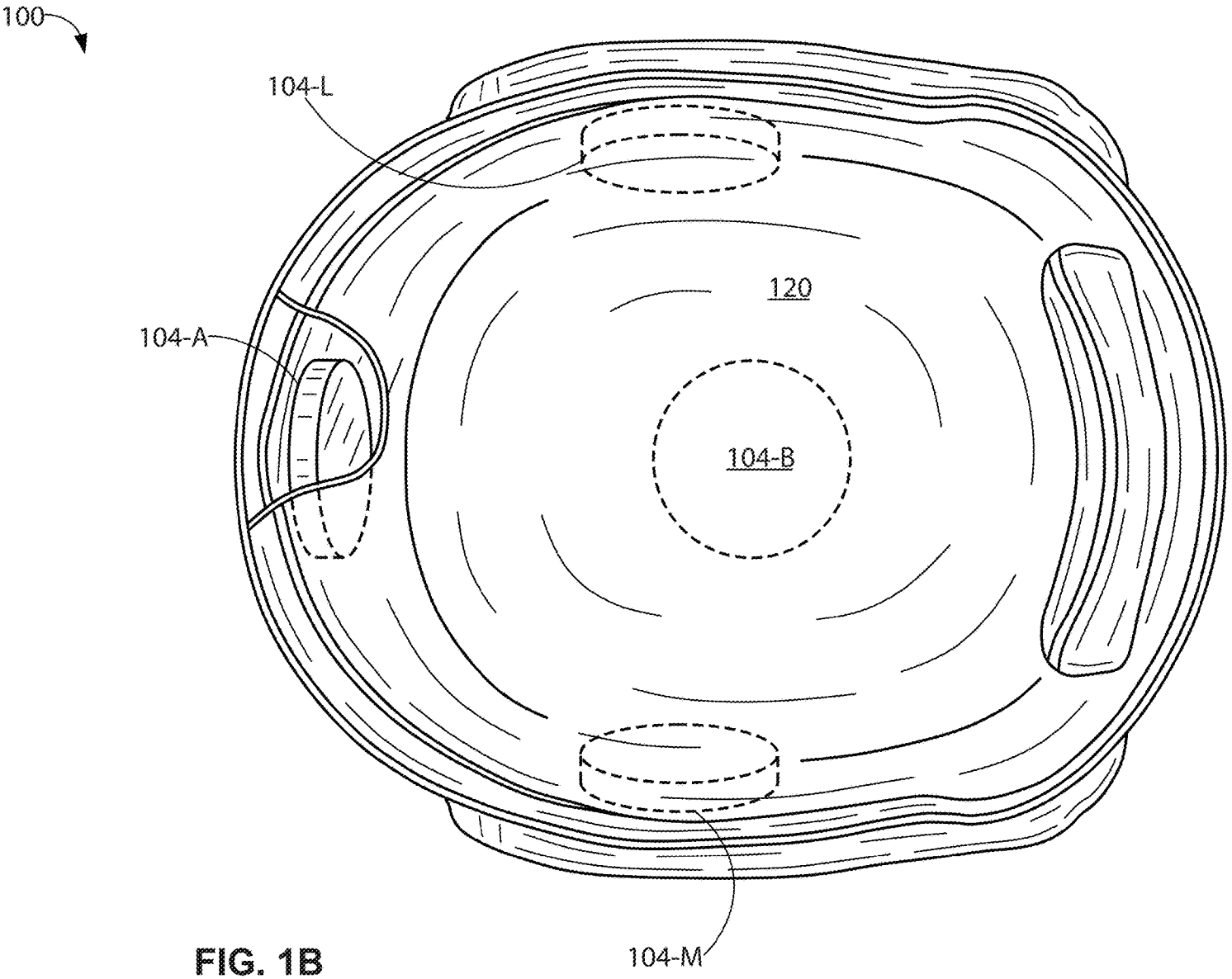
FIG. 1B is an inside view of a helmet in accordance with the first exemplary embodiment.
Figure 1C:
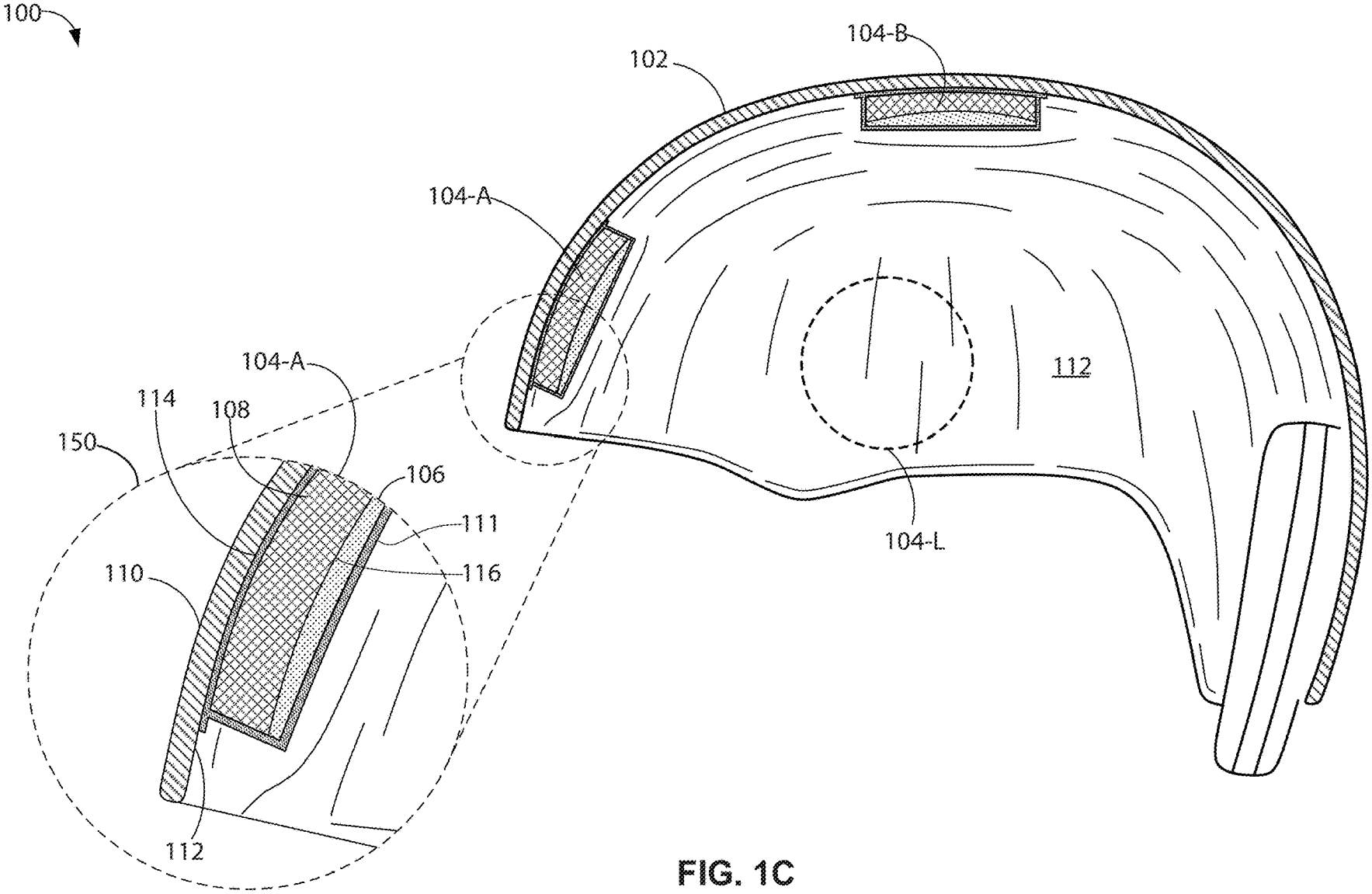
FIG. 1C is a cross-sectional view of a helmet in accordance with the first exemplary embodiment.

Referring to FIGS. 1A-1C, the shell 102 may be configured to receive and protect a head of a person wearing the helmet 100 (called the "user" herein). The shell 102 may include an inner surface 112 and an outer surface 110. Specifically, the shell 102 may be configured to protect the head of the user from impacts, such as impacts created by munitions, impacts experienced during sport, etc. The shell 102 may be made from a variety of impact resistance materials, including numerous rigid polymers (e.g., polycarbonate, ultra-high-molecular-weight polyethylene (UHMWPE), polyether ether ketone (PEEK), and the like) and composite materials (e.g., fiberglass-reinforced polymers, carbon-fiber reinforced polymers, etc.). While the shell 102 is able to protect the user's head generally from various impacts and ballistic threats, the shell 102 may not perform particularly well against blunt impacts. A "blunt impact" is an impact from a blunt object that delivers a force to a localized area that may transfer to the user's head (sometimes referred to herein as a "localized impact"). Examples include falling debris, low velocity vehicle crashes, and trips and falls. Because the shell 102 alone may not sufficiently protect against blunt impacts, the helmet 100 may also include the impact absorbing liner 108.

In some embodiments, the impact absorbing liner 108 includes a plurality of auxetic foam articles 104-A, 104-B, . . . 104-L that are configured to dissipate forces associated with localized impacts delivered to the outer surface of the shell 102. In some embodiments, the auxetic foam articles 104-A, 104-B, . . . 104-L are used to attenuate impact and absorb energy for applications in shoes, automobiles, transportation, dental, medical devices, sporting goods, industrial and manufacturing equipment, packaging, playground equipment, or any other application that requires attenuation of one or more impact events.

The term "auxetic" as used herein generally refers to a material or structure that has a negative Poisson's ratio. As such, when stretched, auxetic materials become thicker (as opposed to thinner) in a direction perpendicular to the applied force. Likewise, when compressed (e.g., by a blunt impact), auxetic materials become thinner in a direction traverse to the applied force. This contraction of the material acts to draw material in from outside of the impact zone to add supplemental energy absorption. One of the ways this can be achieved is through the use of hinge-like structures (sometimes called a "re-entrant" structure) that form within auxetic materials. Conventional materials, including conventional foams (e.g., expanded polypropylene (EPP)), typically have positive Poisson's ratio, meaning that the materials tend to expand in a direction perpendicular to the direction of compression. Conversely, when a conventional material is stretched, it tends to contract in a direction transverse to the direction of stretching. A rubber band is a good example of an article with a positive Poisson's ratio, in that when stretched, the rubber band becomes thinner.

The auxetic foam articles 104-A, 104-B, . . . 104-L may be comprised of closed-celled foam. For example, the closed-cell auxetic foam articles 104-A, 104-B, . . . 104-L may provide better impact attenuation compared to auxetic open-cell foams. Existing polymeric closed-celled foams have traditionally provided better impact attenuation properties compared to polymeric open-celled foams, which are typically used for comfort. In some embodiments, each of the auxetic foam articles 104-A, 104-B, . . . 104-L is a polypropylene auxetic foam article. In other words, each of the auxetic foam articles 104-A, 104-B, . . . 104-L is formed from an expanded polypropylene. In some other embodiments, each of the auxetic foam articles 104-A, 104-B, . . . 104-L is formed from some other closed-cell foam (polyethylene, polystyrene, etc.) or an open-cell foam. For example, the auxetic foam articles 104-A, 104-B, . . . 104-L may be formed from polyurethane, polypropylene, polyvinyl chloride (PVC), vinyl nitrile, or polyesters. In those embodiments where the auxetic foam articles are formed from an expanded polypropylene, a density of the expanded polypropylene is 1.0 lb/ft$^3$ to 10.0 lb/ft$^3$, including all integer lb/ft$^3$ values and ranges there between. For example, the auxetic foam articles 104-A, 104-B, . . . 104-L may have a density between 1.0 lb/ft$^3$ and 10.0 lb/ft$^3$, 2.0 lb/ft$^3$ and 9.0 lb/ft$^3$, 3.0 lb/ft$^3$ and 8.0 lb/ft$^3$, 4.0 lb/ft$^3$ and 7.0 lb/ft$^3$, and 5.0 lb/ft$^3$ and 6.0 lb/ft$^3$. In preferred embodiments, the auxetic foam articles 104-A, 104-B, . . . 104-L has a density between 2.0 lb/ft$^3$ and 4.0 lb/ft$^3$.

As mentioned above, the auxetic foam articles 104-A, 104-B, . . . 104-L are configured to dissipate forces associated with localized impacts delivered to the outer surface 110 of the shell 102. For example, the auxetic foam articles 104-A, 104-B, . . . 104-L may be configured to maintain the acceleration transmitted to the user's head below a threshold acceleration (e.g., at least below 150 G, 175 G, 200 G, 250 G, 275 G, 300 G, 350 G, or 400 G for air crew helmets, HIC of 1000 or 2400 for motorcycle helmets, or below 2.5 kilonewtons (kN), 3.5 kN, 4.45 kN, 5.0 kN, 10 kN, or 12.5 kN according to European standards) when the shell 102 is impacted by a localized force. The shell 102 may be designed to physically stop a bullet, while an auxetic foam article positioned at the impact location is configured to dissipate the forces associated with the stopped bullet (e.g., to prevent those forces and accelerations from injuring the user's head). In another example, the shell 102 may be designed to generally protect a user's head from a blunt impact, such as a crown of another helmet (e.g., in a football game), while an auxetic foam article positioned at the impact location is configured to dissipate the forces associated with the blunt impact.

Referring to FIG. 1A, auxetic foam article 104 may be disk shaped and may be configured to maintain a peak acceleration below 150 G (preferably 130 G) when the shell 102 is subjected to a localized impact of approximately 25 Joules (J). In some embodiments, the auxetic foam article 104 may be a disk shape having a thickness of approximately 0.50 inches (plus or minus 0.05 inches, i.e., a reasonable manufacturing tolerance). However, the thickness of auxetic foam article 104 may vary based on the application. The auxetic foam article 104 may be any shape, such as circular, oval, square, rectangular, diamond, triangular, or any other shape desired. In some embodiments, some of the auxetic foam articles 104-A, 104-B, . . . 104-L are a first shape and some of the auxetic foam articles 104-A, 104-B, . . . 104-L are a second shape different from the first shape. In other embodiments (e.g., when the auxetic foam articles 104-A, 104-B, . . . 104-L form a continuous liner that covers the inner surface of the shell 102), the auxetic foam articles 104-A, 104-B, . . . 104-L have a shape that substantially complements a shape of the human head.

The auxetic foam article 104 may have a thickness between 0.1 inches and 3.0 inches, 0.5 inches and 2.5 inches, or 1 inch and 2 inches. In some embodiments, the auxetic foam article 104 has a diameter between 0.5 inches and 3 inches, 1 inch and 2.5 inches, or 1.5 inches and 2.5 inches. In a preferred embodiment, the auxetic foam article 104 has a thickness between 0.5 inches and 1 inch and a diameter of approximately 2.5 inches. The auxetic foam article 104 may be configured to absorb, for example, approximately 60 joules (J) of energy when subjected to multiple impacts at 10 feet per second, and absorb approximately 115 J of energy when subjected to multiple impacts at 14 feet per second. The auxetic foam article 104 may be configured to absorb between 25 J and 200 J, 75 J and 175 J, or 125 J and 150 J of energy.

In some embodiments, helmet 100 includes a plurality of the auxetic foam articles 104-A, 104-B, . . . 104-L. For example, as shown in FIG. 1A, helmet 100 may include three auxetic foam articles 104-A, 104-B, 104-L. However, helmet 100 may include more than three auxetic foam articles 104. Referring to FIG. 1B, helmet 100 may include auxetic foam article 104-M positioned opposite to the auxetic foam article 104-L on the other side of the shell 102. In some embodiments, the auxetic foam articles 104-A, 104-B, . . . 104-L cover an inner surface of the shell 102. In some other embodiments, the auxetic foam articles 104-A, 104-B, . . . 104-L are distributed at multiple different locations on the inner surface of the shell 102, whereby the multiple different locations are selected based on known locations of the human head that are vulnerable to localized impacts. For example, the auxetic foam articles 104-A, 104-B, . . . 104-L (and 104-M) may be positioned at the locations shown in FIGS. 1A and 1B, and additional auxetic foam articles 104 may be positioned elsewhere, such as on the back of the helmet 100. In other embodiments, the auxetic foam articles 104-A, 104-B, . . . 104-L substantially cover the inner surface 112 of the shell 102. In some embodiments, the impact absorbing liner 108 is comprised of the auxetic foam articles 104-A, 104-B, . . . 104-L and substantially covers the inner surface 112 of helmet 100. For example, the auxetic foam articles 104-A, 104-B, . . . 104-L may form a continuous liner that covers the inner surface 112 of the shell 102. In some embodiments, the auxetic foam articles 104-A, 104-B, . . . 104-L are positioned in a contiguous fashion to substantially cover the inner surface 112 of the shell 102. In some embodiments, the auxetic foam articles 104-A, 104-B, . . . 104-L cover only a portion of the inner surface 112 of the shell 102.

In some embodiments, the impact absorbing liner 108 includes one or more structures in addition to the auxetic foam articles 104-A, 104-B, . . . 104-L. For example, the impact absorbing liner 108 may include one or more traditional foam articles that are paired with the auxetic foam articles 104-A, 104-B, . . . 104-L. In another example, the impact absorbing liner 108 may include a general foam layer whereby the auxetic foam articles 104-A, 104-B, . . . 104-L are integrated with the general foam layer. In some embodiments, the foam layer substantially covers the inner surface 112 of the helmet. In some other embodiments, the impact absorbing liner 108 only includes the auxetic foam articles 104-A, 104-B, . . . 104-L.

Referring to FIG. 1C, the padding 106 may be coupled to the impact absorbing liner 108 and configured to directly contact the head of the user when helmet 100 is worn by the user. In some embodiments, the padding 106 includes individual pieces of padding that are coupled to a respective foam article of the plurality of auxetic foam articles 104-A, 104-B, . . . 104-L. Padding 106 may be comprised of a non-auxetic material. In some embodiments, the padding 106 is a continuous structure this is coupled to the plurality of auxetic foam articles 104-A, 104-B, . . . 104-L. For example, the padding 106 may be a webbed structured that covers each of the plurality of auxetic foam articles 104-A, 104-B, . . . 104-L. The padding 106 may be made from various textiles and fabrics that can comfortably interact with the human head. For example, padding 106 may be comprised of foam, cotton, polyester, nylon, or any combination thereof. In some embodiments, the padding 106 is comprised of a polyether foam and/or an open-celled foam. In some embodiments, auxetic foam articles 104 may be a pad. The pad may include covering 111 and the padding 106. The padding 106 may be a comfort layer and may have a thickness less than the thickness of auxetic foam articles 104. The padding 106 may be disposed between the covering 111 and the auxetic foam article 104. Covering 111 may be configured to cover auxetic foam articles 104 and/or padding 106.

Referring to FIG. 1B, an interior view of helmet 100 is illustrated in accordance with some embodiments. A section of the shell 102 has been removed in FIG. 1B for ease of illustrating one of the auxetic foam articles 104. In some embodiments, helmet 100 includes a structure to cover the auxetic foam articles 104-A, 104-B, . . . 104-L. For example, the auxetic foam articles 104-A, 104-B, . . . 104-L may be covered by covering 120. In some embodiments, each auxetic foam article 104-A, 104-B, . . . 104-L includes its own covering 111. The covering 120 or 111 may be comprised of foam, cotton, polyester, nylon, or any combination thereof. In some embodiments, the covering 120 or 111 is comprised of a mesh fabric or other type of fabric to allow for breathability of the padding 106 and/or the auxetic foam article 104. In some embodiments, the covering 120 is coupled to or part of the inner surface 112 of the shell 102. In such embodiments, the auxetic foam articles 104-A, 104-B, . . . 104-L are positioned between the outer surface 110 of the shell 102 and the inner surface 112 of the shell 102. In some embodiments, the covering 120 is part of the impact absorbing liner 108. For example, the auxetic foam articles 104-A, 104-B, . . . 104-L are embedded within impact absorbing liner 108. In some embodiments, the auxetic foam articles 104-A, 104-B, . . . 104-L are not covered by the covering 120. In some embodiments, the covering 120 or 111 is simply the padding 106. In such embodiments, the auxetic foam articles 104-A, 104-B, . . . 104-L are coupled to the inner surface 112 of the shell 102 and are substantially exposed inside the helmet 100. In such embodiments, the padding 106 may be coupled to the auxetic foam articles 104-A, 104-B, . . . 104-L and configured to directly contact the head of the user. For example, the padding 106 may form a comfort boundary between the auxetic foam articles 104-A, 104-B, . . . 104-L and the user's head.

Referring to FIG. 1C, a cross-sectional view of an exemplary helmet 100 is illustrated in accordance with some embodiments. The embodiments discussed below with reference to FIG. 1C may be modified and combined with the embodiments discuss above with reference to FIG. 1B. For example, a shape of the respective auxetic foam article 104-A discussed with reference to FIG. 1C can be applied to one or more of the configurations of the shell 102, auxetic foam articles 104-A, 104-B, . . . 104-L, and the covering 120 or 111 discussed above with reference to FIG. 1B.

In some embodiments, the auxetic foam articles 104-A, 104-B, . . . 104-L are coupled to the inner surface 112 of the shell 102. FIG. 1C includes a magnified view 150 that shows a close-up of the shell 102. For example, the magnified view 150 shows the outer surface 110 of the shell 102 and the inner surface 112 of the shell 102, and the coupling between the inner surface 112 of the shell 102 and a respective auxetic foam article 104-A. As shown in the magnified view 150, a top surface 114 of the respective auxetic foam article 104-A has a convex curvature and a bottom surface 116 of the respective auxetic foam article 104-A has a concave curvature. In some embodiments, the convex curvature of the respective auxetic foam article 104-A is designed to generally complement a curvature of the inner surface 112 of the shell 102, while the concave curvature of the respective auxetic foam article 104-A is designed to generally complement a curvature of the human head. The magnified view 150 also shows coupling between the respective auxetic foam article 104-A and the padding 106. In some embodiments, the respective auxetic foam article 104-A is coupled to the inner surface 112 of the shell 102 and the padding 106 using a fastener. For example, the auxetic foam article 104-A may be coupled to padding 106 via a chemical fastener, such as an adhesive or epoxy. Alternatively or in addition, the auxetic foam article 104-A may be coupled to the inner surface 112 of the shell 102 and the padding 106 using a mechanical fastener, such as bolts, screws, hook-and-loop mechanism, etc. The characteristics of the respective auxetic foam article 104-A discussed with reference to FIG. 1C may be applied to each of the other auxetic foam articles 104 discussed herein.

Figure 2A:
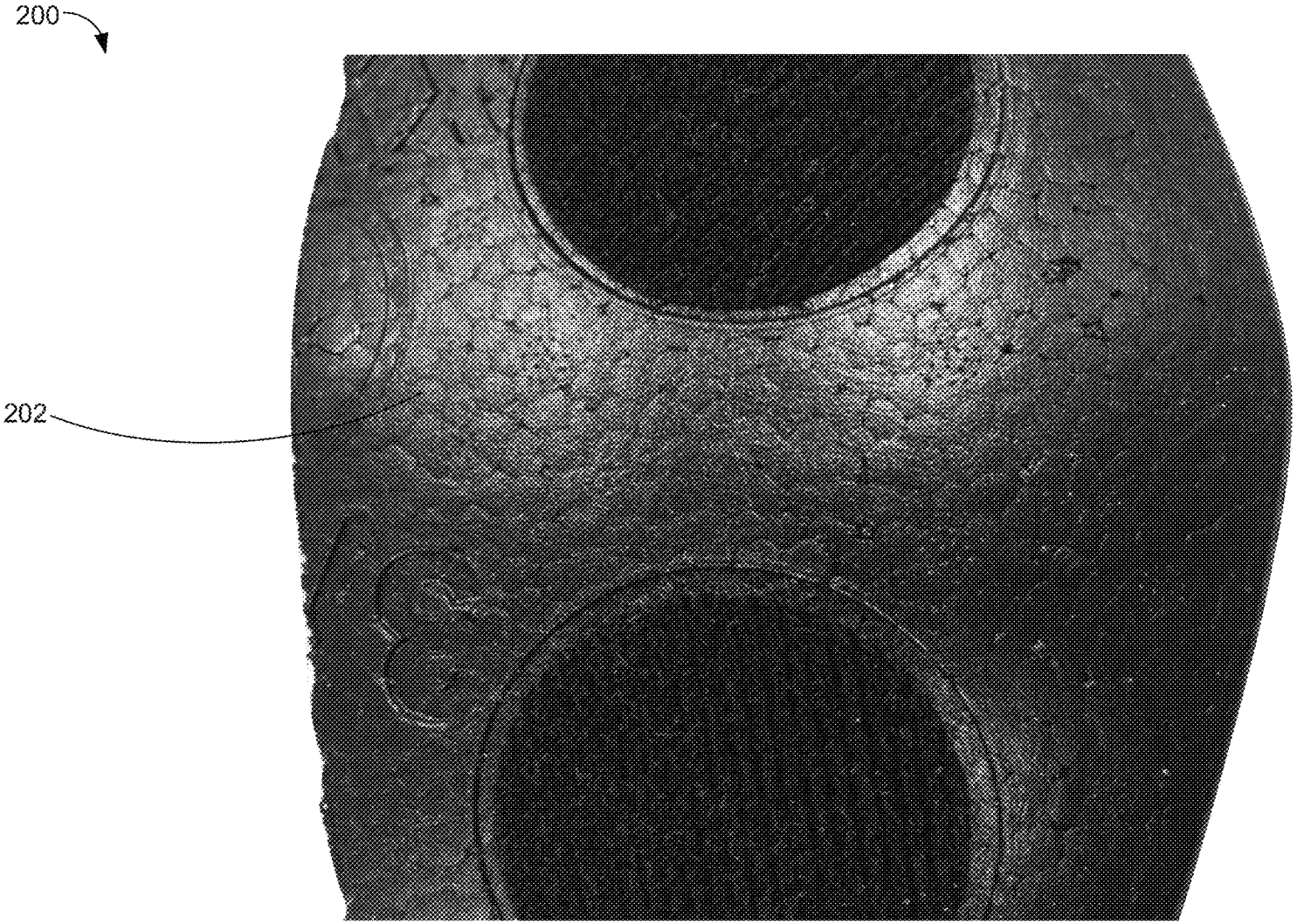
FIG. 2A shows a photograph of an example foam article that has not undergone auxetic conversion in accordance with a second exemplary embodiment.
Figure 3A:
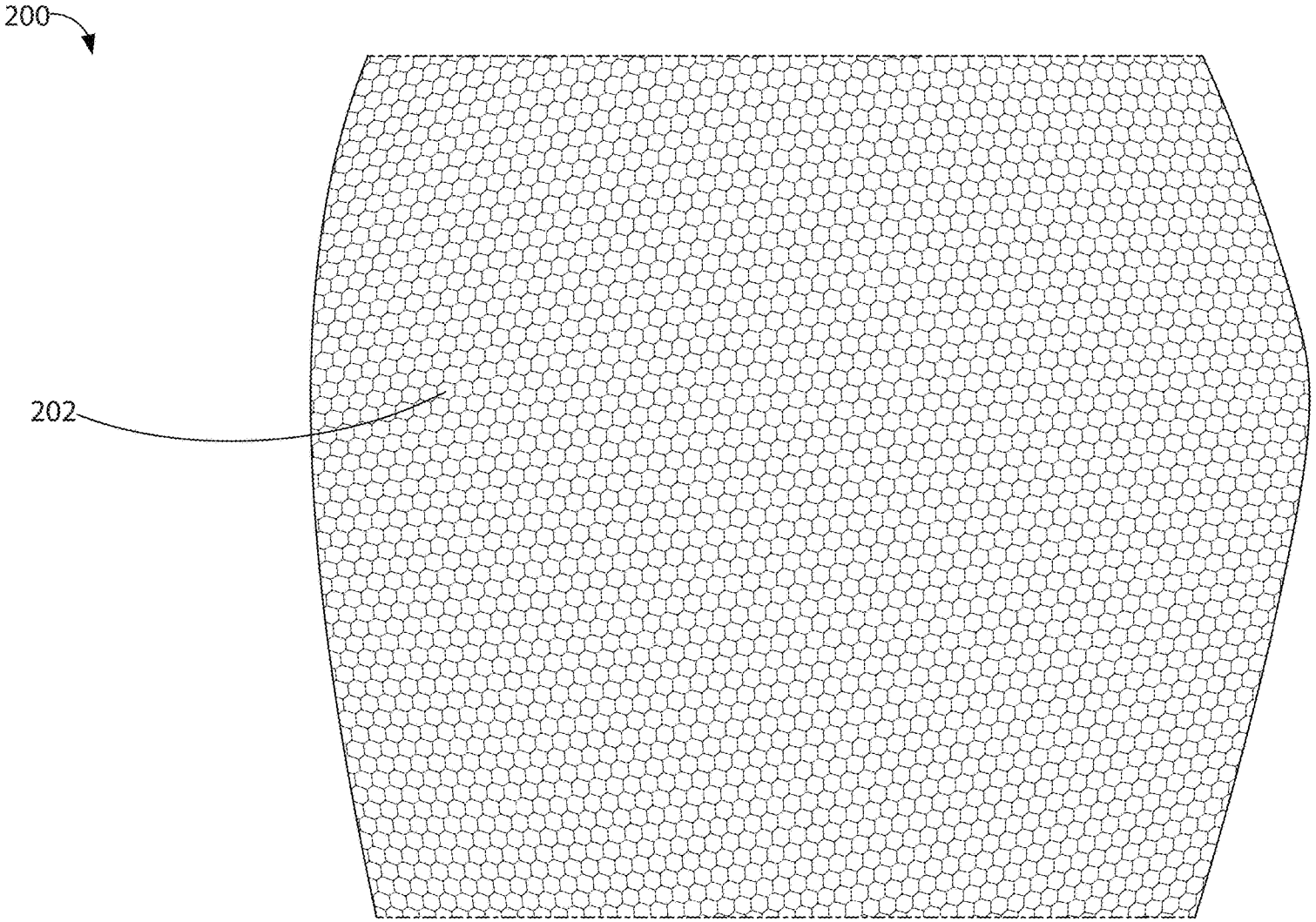
FIG. 3A shows an illustration of a foam article similar to the foam article of FIG. 2A that has not undergone auxetic conversion in accordance with the second exemplary embodiment.

Referring to FIGS. 2A and 3A, an exemplary foam article 200 that has not undergone auxetic conversion is illustrated in accordance with some embodiments. In some embodiments, foam article 200 is a propylene foam article. The foam article 200 is a closed-cell foam having a positive Poisson's ratios, such that the foam article 200 becomes thinner in a direction perpendicular to the applied force. The foam article 200 may be used in a variety of applications such as dental, medical devices, automobiles, transportation, sporting goods, shoes, military equipment, packaging, playground equipment or any other application for providing attenuation of multiple impact events.

Figure 4A:
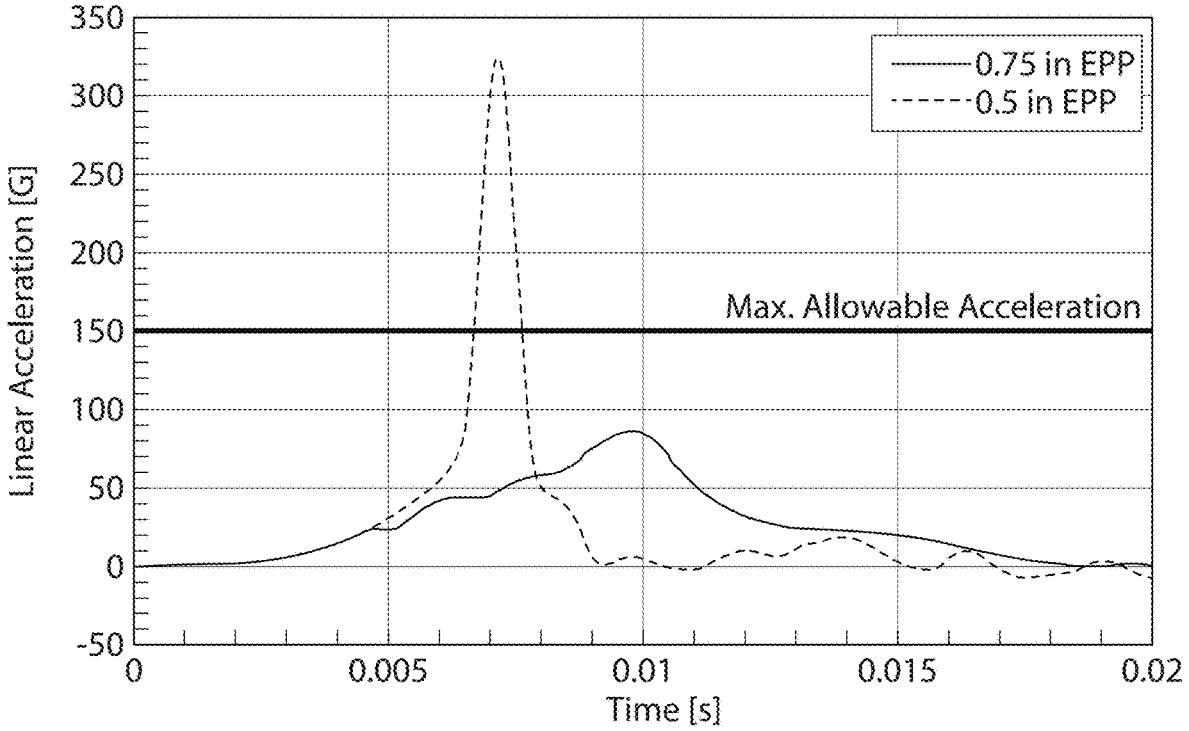
FIG. 4A is a graph of the relationship between linear acceleration and time of a non-auxetic article.

In some embodiments, to satisfy impact resistance standards, a thickness of these foam articles is increased, for example, to at least 0.75 inches, which can be undesirable in many applications. Referring to FIG. 4A, an impact test of a 0.75 inch thick polypropylene foam article coupled to a crown of a plastic helmet was conducted according to the ACH Purchase Description AR-PD 10-02. The impact test revealed that the 0.75 inch thick polypropylene foam article maintain a peak acceleration below 150 G when the helmet was impacted by a hemispherical impactor. As such, the 0.75 inch thick polypropylene foam article passed the impact test.

However, an impact test of a 0.50 inch thick polypropylene foam article coupled to a crown of a plastic helmet revealed that the 0.50 inch thick polypropylene foam article failed to maintain a peak acceleration below 150 G when the helmet was impacted by the hemispherical impactor, and, thus, the 0.50 inch thick polypropylene foam article failed the impact test. Indeed, the 0.50 inch thick polypropylene foam article failed to maintain a peak acceleration below 300 G on at least one occasion during the impact testing.

Figure 2B:
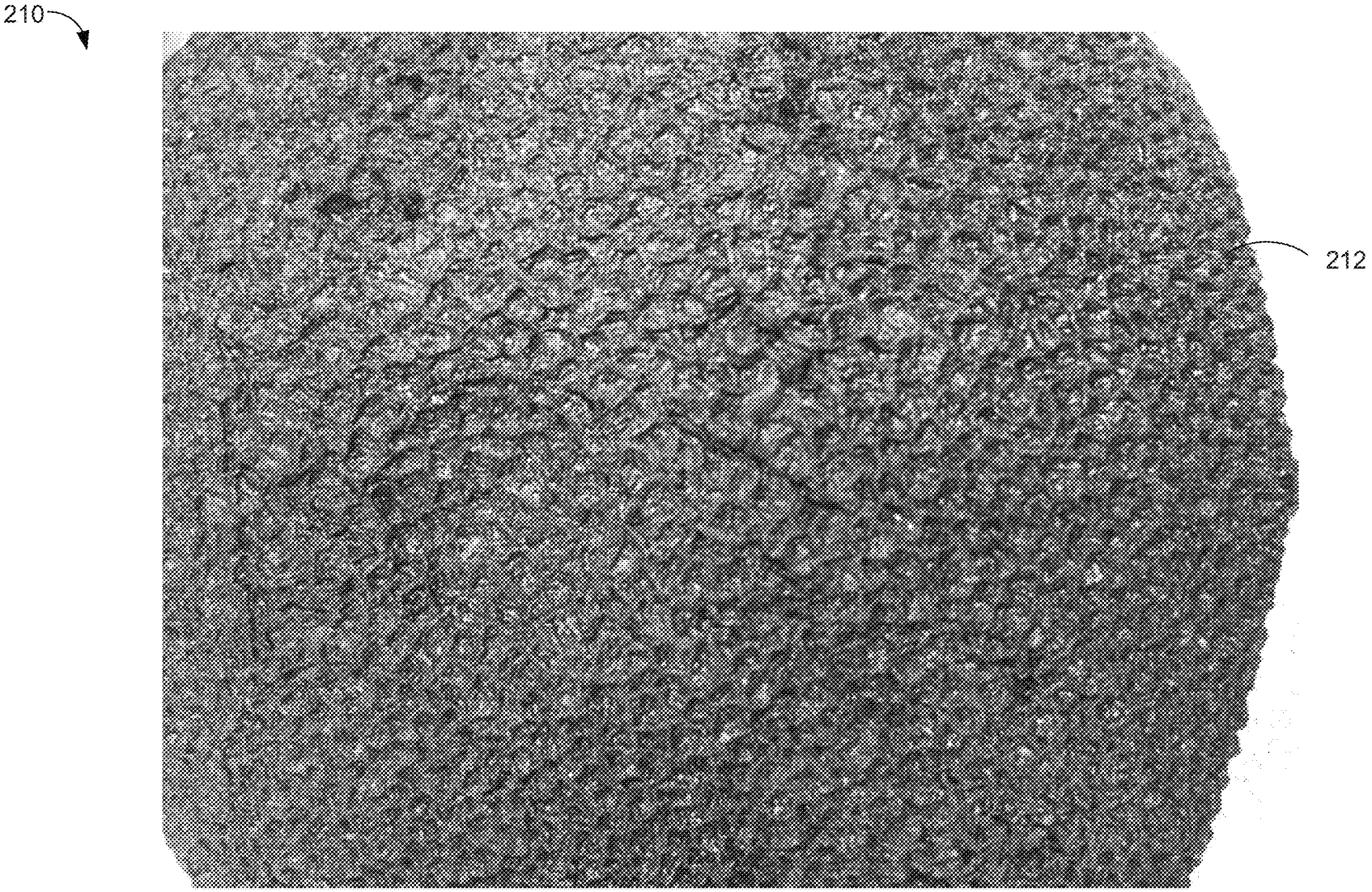
FIG. 2B shows a photograph of an example foam article similar to the foam article of FIG. 2A that has undergone auxetic conversion in accordance with the second exemplary embodiment.
Figure 3B:
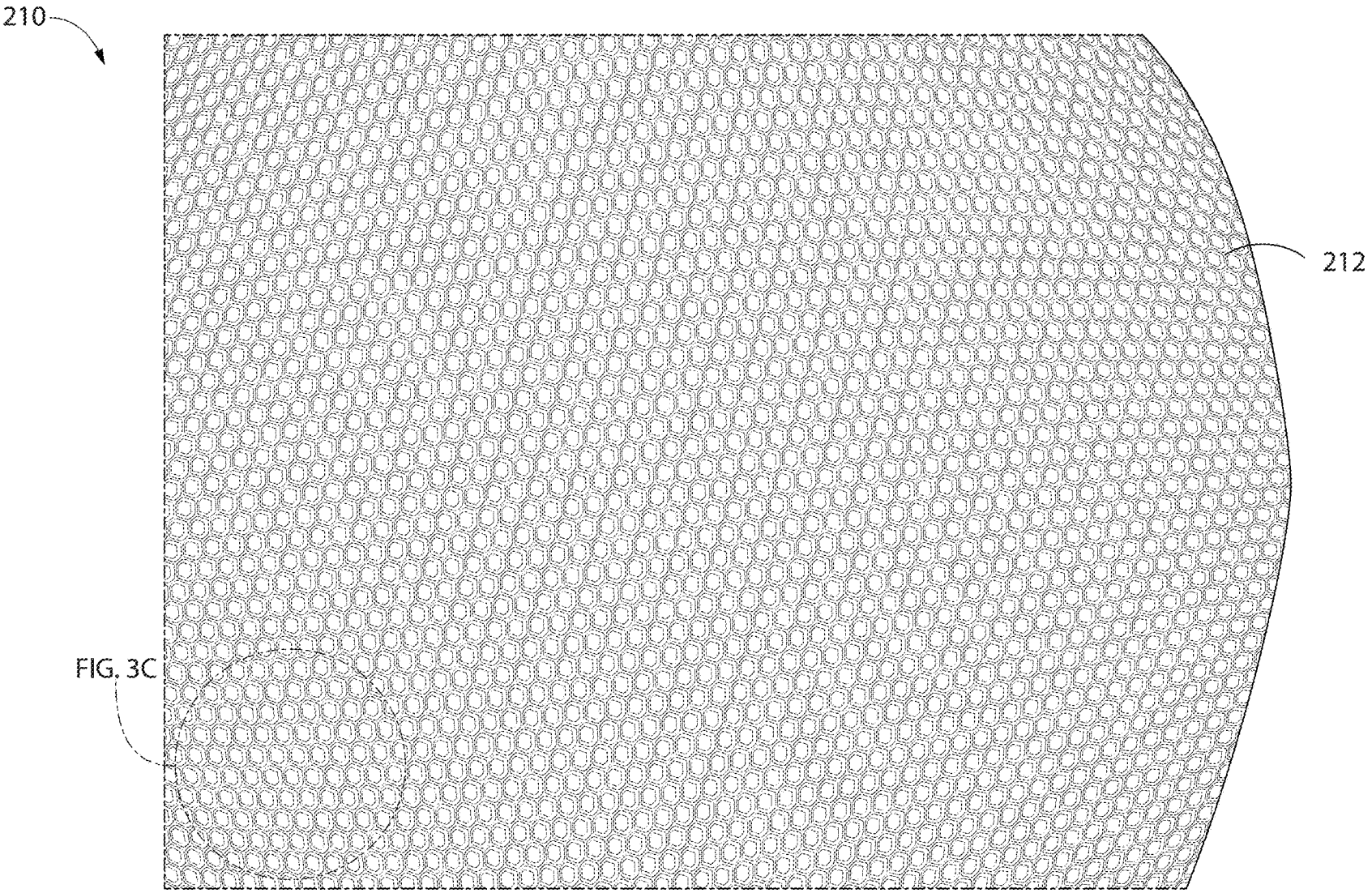
FIG. 3B shows an illustration of the example foam article similar to the foam article of FIG. 2B after undergoing auxetic conversion in accordance with the second exemplary embodiment.
Figure 3C:
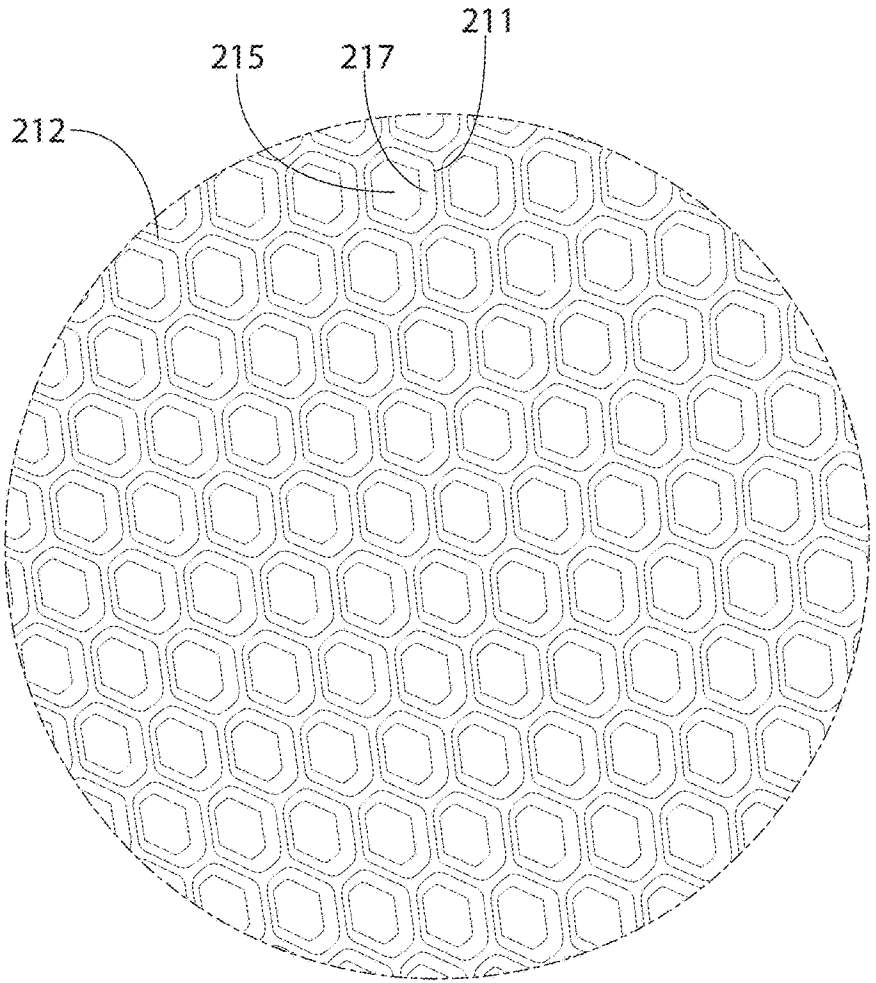
FIG. 3C is a zoomed in area of FIG. 3B.

Referring to FIGS. 2B and 3B-3C, an exemplary foam article 210 is illustrated that has undergone auxetic conversion in accordance with some embodiments (referred to henceforth as an "auxetic foam article 210"). In some embodiments, the auxetic foam article 210 is a polypropylene auxetic foam article. The auxetic foam article 210 may be made from the foam article 200, an article similar to the foam article 200, or a similar expanded foam, such as expanded polypropylene foam. For example, the auxetic foam article 210 may have been originally a closed-cell foam that was transformed into an auxetic foam article 210 during an auxetic conversion process, which is described below with reference to FIGS. 7A-7B and FIG. 8. The auxetic conversion process may cause cells 202 in the closed-cell foam (FIGS. 2A and 3A) to partially collapse, which results in the partially collapsed cells 212 (FIGS. 2B and 3B-3C). In some embodiments, collapsed cells 212 have been reduced in size by approximately 50% to 70% compared to cells 202.

Figure 5A:
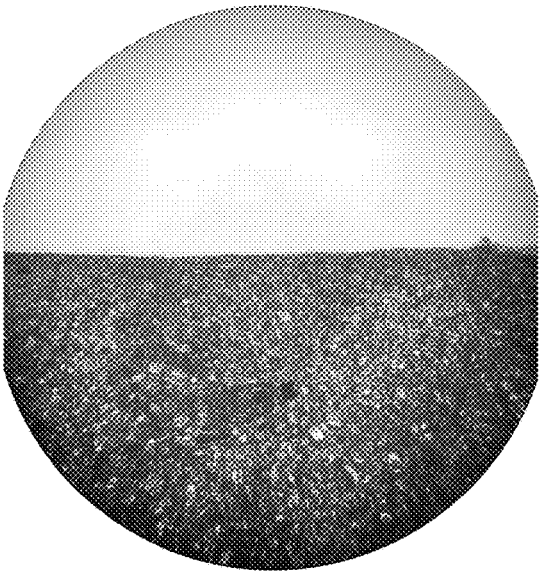
FIG. 5A is a microscopy image of an example foam article that has not undergone auxetic conversion in according with a third embodiment.
Figure 5B:
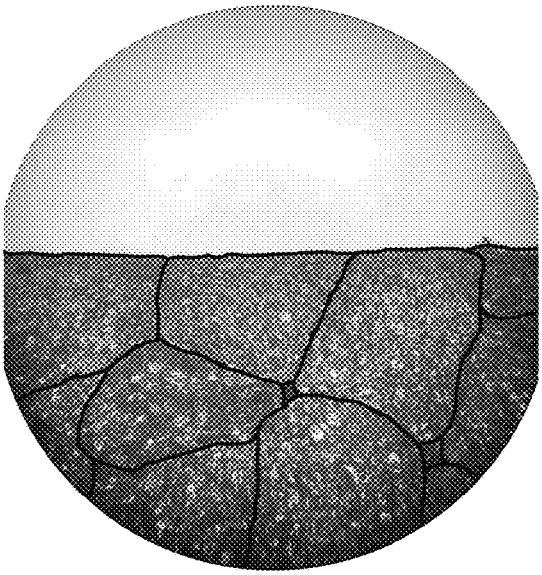
FIG. 5B is the microscopy image of FIG. 5A with cells annotated for viewing purposes.
Figure 6A:
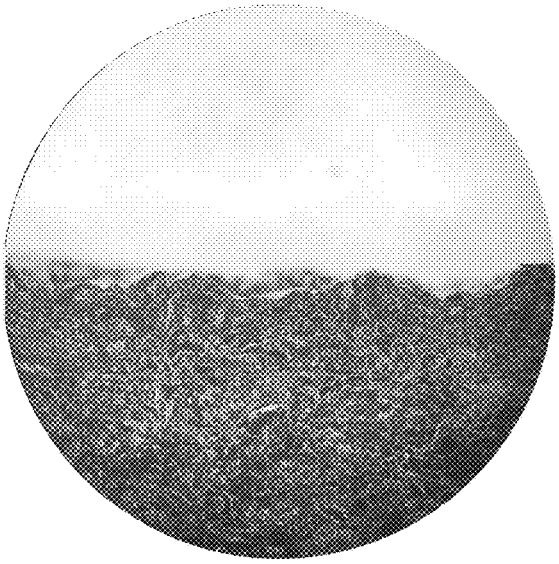
FIG. 6A is a microscopy image of an example foam article that has undergone auxetic conversion in according with the third embodiment.
Figure 6B:
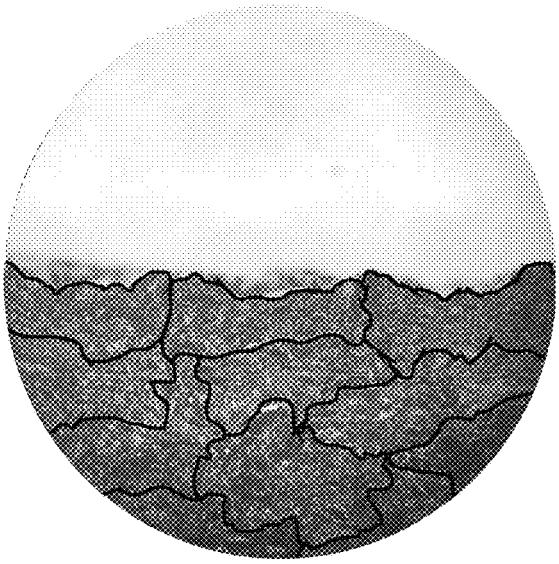
FIG. 6B is the microscopy image of FIG. 6A with cells annotated for viewing purposes.

Referring to FIGS. 5A-6B, a non-auxetic article may be converted to an auxetic article. For example, a non-auxetic article may be converted to an auxetic article by collapsing the cells that make up the non-auxetic article. FIGS. 5A and 5B show microscopy images of a non-auxetic foam comprised of cells. The boundaries of each cell comprising the non-auxetic article of FIG. 5A have been annotated in FIG. 5B. FIGS. 6A and 6B show a microscopy image of an auxetic foam comprised of cells, which have been collapsed. The boundaries of each cell comprising the auxetic article of FIG. 6A have been annotated in FIG. 6B.

Referring to FIG. 3C, in some embodiments, each cell 212 has a top surface 211, which may include an inner portion 215 and outer portion 217. The outer portion 217 may surround the inner portion 215, and the inner portion 215 may be collapsed compared to the outer portion 217. For example, the inner portion 215 may be collapsed and thus disposed closer to the bottom surface of foam article 210 compared to outer portion 217. In some embodiments, the top surface 211 of each cell 212 is concave. In some embodiments, the top surface 114 of the auxetic foam article 104 is an uneven surface comprised of a plurality of concave portions.

In some embodiments, foam article 200 may be converted to auxetic foam article 210 while being disposed within a mold or partial mold. For example, during the auxetic conversion process, all or a portion of foam article 200 may be disposed within a mold or partial mold and may be converted to the auxetic foam article 210 while remaining within the mold or partial mold. In some embodiments, a coating is applied to the top surface 114 and/or the bottom surface 116 of the auxetic foam article 210 to make the top surface 114 and/or the bottom surface 116 smooth. In some embodiments, the top surface 114 and/or the bottom surface 116 of the auxetic foam article 210 may be cut and/or sanded to make the surface smooth.

In some embodiments, each cell 212 may have a surface angle or re-entrant angle $\alpha$ greater than 180 degrees relative to the top surface 211. For example, the cells 212 may have re-entrant angles from approximately 180° to approximately 360°, approximately 210° to approximately 330°, or approximately 240° to approximately 300°. In some embodiments, the re-entrant angle is any angle that results in the auxetic foam article 104 having a negative Poisson's ratio.

Figure 4B:
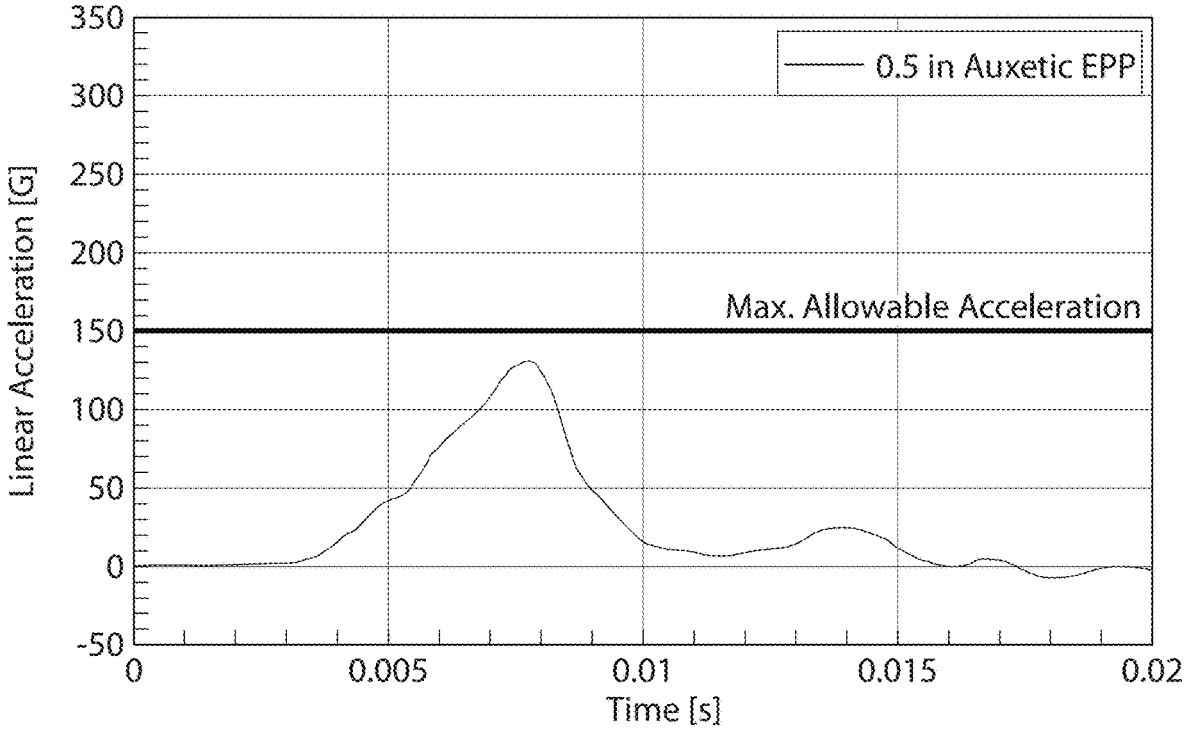
FIG. 4B is a graph of the relationship between linear acceleration and time of an auxetic article.

As mentioned above, an "auxetic" is a material or structure that has a negative Poisson's ratio, such that when stretched, the auxetic material becomes thicker (as opposed to thinner) in a direction perpendicular (and/or transverse) to the applied force. In some embodiments, the auxetic foam article 210 is configured to become thicker (as opposed to thinner, as is the case with the foam article 200), temporarily, in response to a localized impact. Referring to FIG. 4B, an impact test of a 0.50 inch thick polypropylene auxetic foam article coupled to a crown of a plastic helmet was conducted to illustrate the benefits associated with the auxetic foam article 210. The impact testing was again conducted according to the ACH Purchase Description AR-PD 10-02. The impact test revealed that the 0.50 inch thick polypropylene auxetic foam article maintain a peak acceleration below 150 G when the helmet was impacted by a hemispherical impactor. As such, the 0.50 inch thick polypropylene auxetic foam article passed the impact test, and, surprisingly, demonstrated nearly a 100 percent improvement over the 0.50 inch thick polypropylene foam article (which, as discussed above, did not pass the impact test).

In some embodiments, the auxetic foam article 210, with a thickness of 0.50 inches, is incorporated into, for example, the helmet 100 and sufficiently protects a user of the helmet 100. For example, helmet 100 having the auxetic foam article 210 may provide protection that complies with impact safety standards. Previous impact attenuation systems, such as helmet 100, relied on foam articles with thicknesses of 0.75 inches or more in order to comply with impact safety standards, as discussed above with reference to FIGS. 2A and 3A. However, increasing the size, and thus the weight, of a helmet (even by 0.25 inches) increases the rotational inertia of the helmet, which can lead to an increased risk of brain injury, in addition to being uncomfortable to the user and impairing their situational awareness. As such, while a reduction in thickness of 0.25 inches may seem insignificant, the auxetic foam article 210 detailed herein, when incorporated into the helmet 100, may reduce the rotational inertia of the helmet 100, thereby creating an overall safer helmet system. However, auxetic foam article 210 may be used for a variety of applications such as dental, medical devices, automobiles, transportation, sporting goods, shoes, military equipment, packaging, playground equipment or any other application for providing impact attenuation. In some embodiments, the auxetic articles 104 may be used to reduce the thickness of helmets while providing impact attenuation. For example, helmets, such as baseball helmets, hockey helmets, football helmets, using the auxetic foam article 104 may have a thickness less than helmets using non-auxetic material.

Figure 7A:
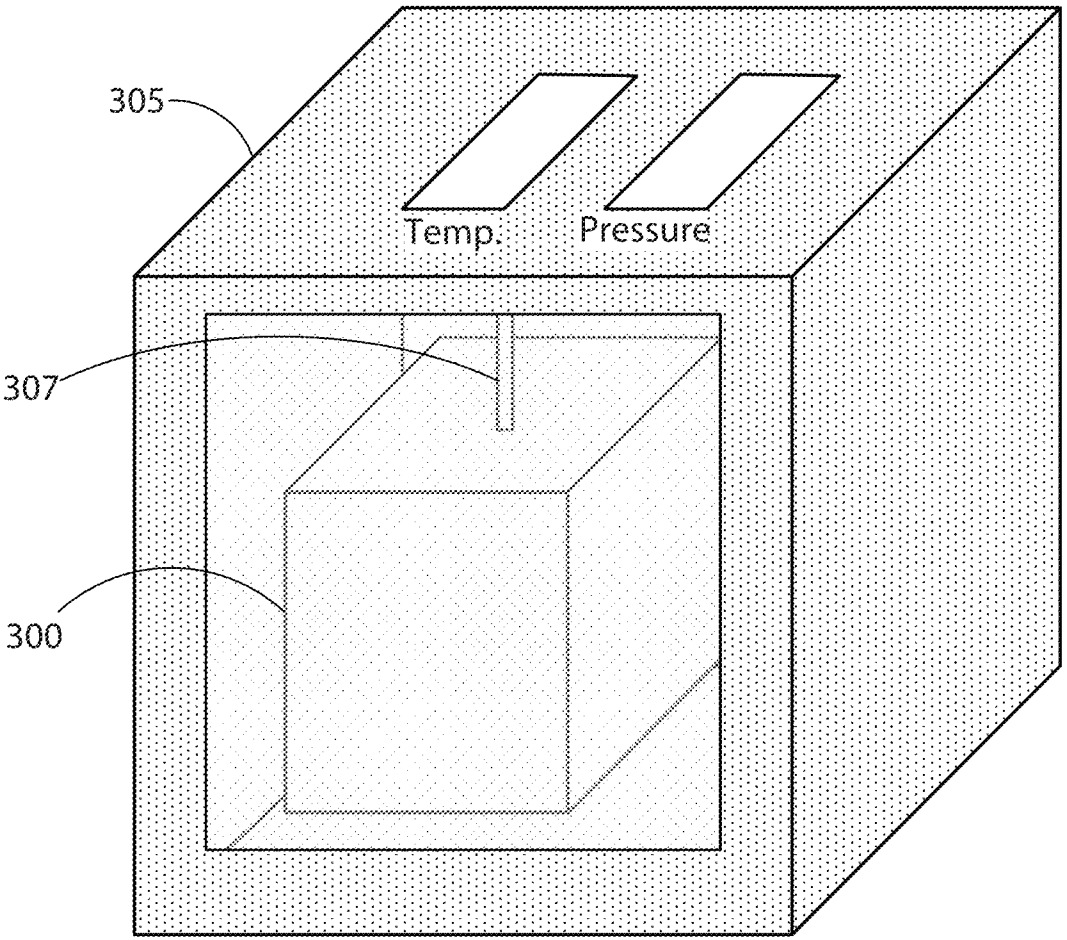
FIG. 7A shows an example foam article positioned in an oven before the application of heat and pressure in accordance with a fourth exemplary embodiment.

Referring to FIG. 7A, an example foam article 300 positioned in an oven 305 before the auxetic conversion process is initiated, for example, before the application of heat and pressure, is illustrated in accordance with some embodiments. Foam article 300 may be a polypropylene foam article or a polystyrene foam article. The foam article 300 may be an example of the foam article 200 (FIGS. 2A and 3A). As shown, the foam article 300 is suspended in an oven 305 via a hanger 307. In some embodiments, the foam article 300 is suspended by a single point. In other embodiments, the foam article 300 is suspended by two or more points. The foam article 300 may be suspended such that it does not contact the walls of the oven 305. However, foam article 300 may be placed within oven 305 in any manner desired. For example, foam article 300 may be placed on a surface within oven 305. The resulting auxetic foam article 310 (FIG. 7C) may be an isotropic material, if desired. In FIG. 7A, the oven 305 is at or near atmospheric pressure and room temperature. In some embodiments, the oven 305 is maintained at the desired temperature to prevent having to heat or cool the oven 305, which can be time consuming.

Figure 7B:
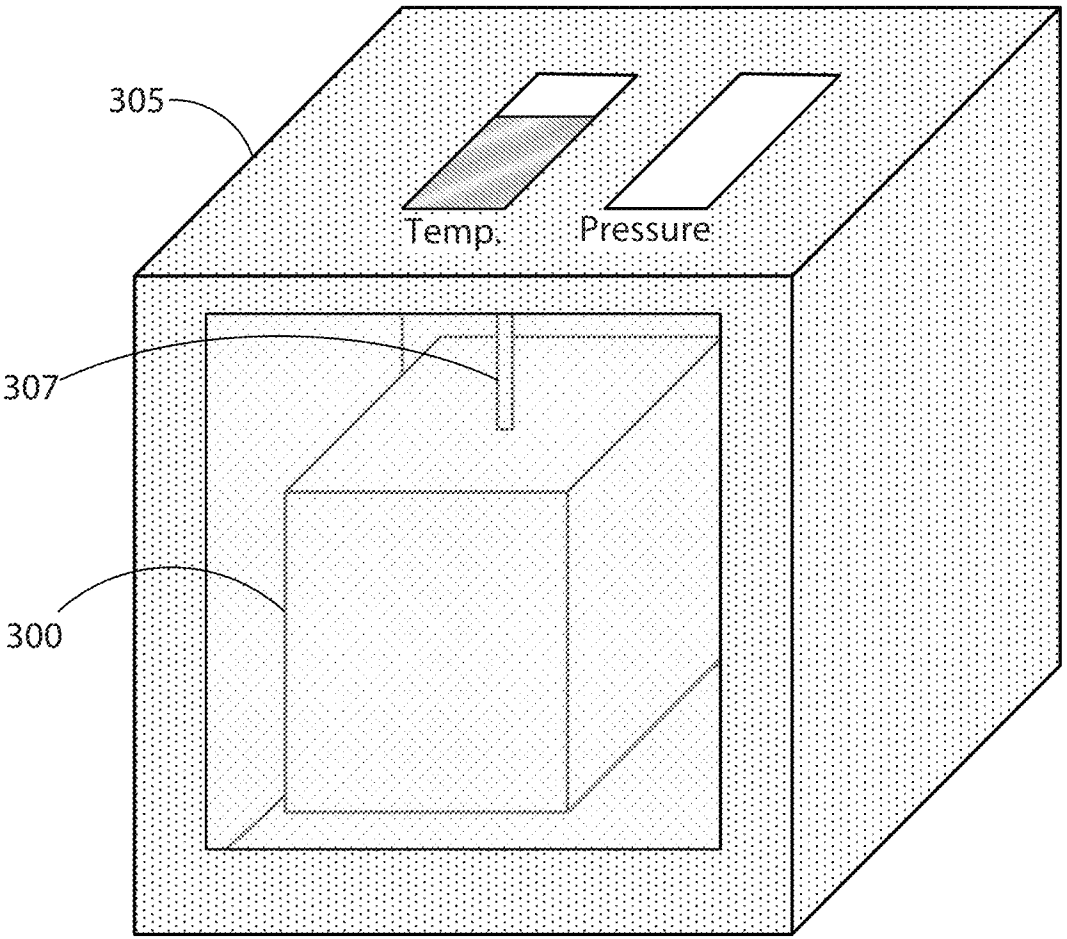
FIG. 7B-7C show the example foam article from FIG. 7A after the application of heat and pressure in accordance with the fourth exemplary embodiment.

Referring to FIG. 7B, the auxetic foam article 300 being heated in the oven 305 is shown, as indicated by the temperature gauge in FIG. 7B. As explained in more detail below in FIG. 8, the auxetic foam article 300 may be heated to a predefined temperature, such as a softening temperature of the article. In some embodiments, heating the auxetic foam article 300 may occur at least partially under vacuum. In some embodiments, the auxetic foam article 300 may be subject to a pressure between approximately −14 PSI and approximately 100 PSI and a temperature between approximately 35° Celsius and approximately 150° Celsius. The heating may cause cells 202 in the closed-cell foam of the article 300, which is similar to the foam article 200, to soften. The softening of the cells 202 and the applied pressure allows the cells 202 to at least partially collapse when the article 300 is subjected to the pressure, which is a necessary step in the auxetic conversion process. In some embodiments, pressure may be applied in a vacuum to cause the cells 202 to at least partially collapse.

Figure 7C:
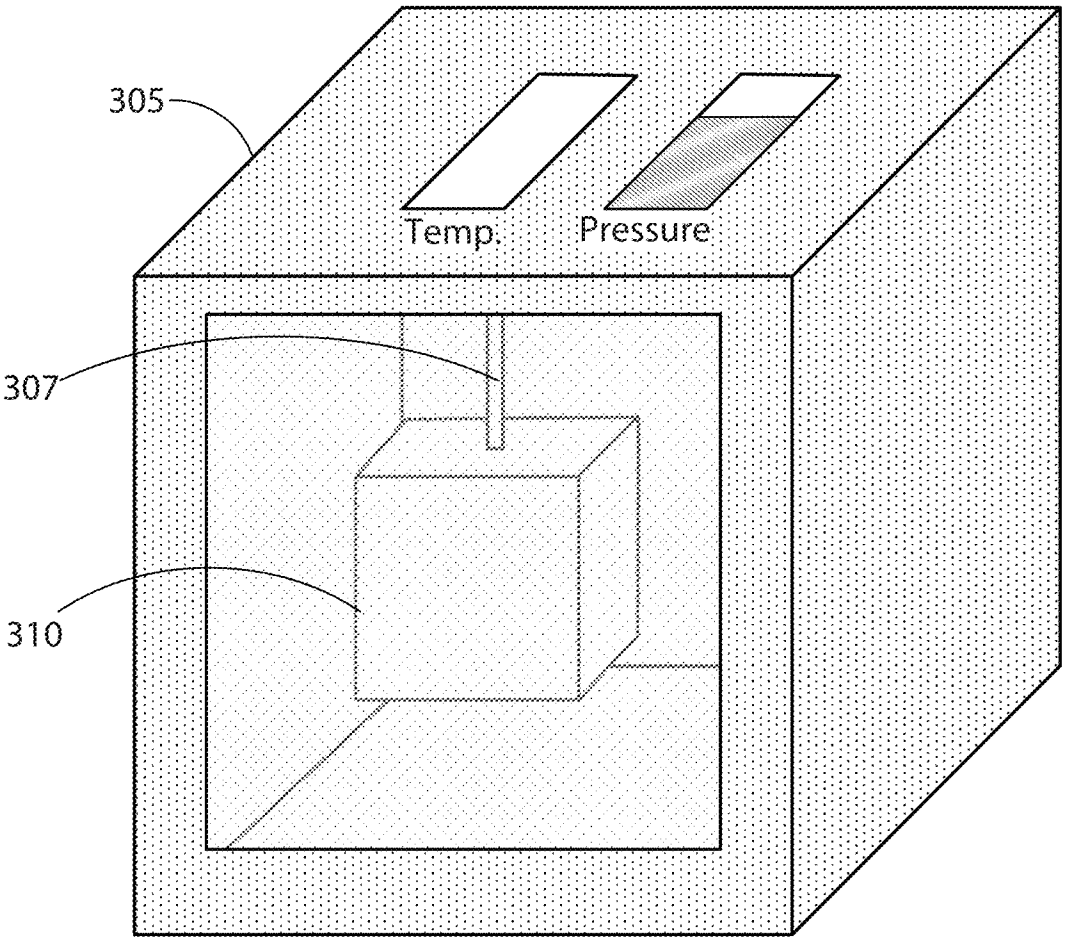

FIG. 7C shows an example auxetic foam article 310, which is obtained by subjecting the article 300, where the cells have been softened, to an elevated pressure for a period of time, as indicated by the pressure gauge in FIG. 7C. Subjecting the article 300 to the changes in pressure (increasing or decreasing) causes gas in the cells softened by the heating to at least partially escape from the cells, which transforms the article 300 into the auxetic foam article 310 with a plurality of partially collapsed cells, such as the partially collapsed cells 212 shown in FIGS. 2B and 3B-3C. For example, the foam article 300 of FIGS. 7A and 7B may be converted into the auxetic foam article 310 of FIG. 7C as a result of an auxetic conversion process. Comparing FIGS. 7A and 7B with FIG. 7C, the auxetic foam article 310 may shrink relative to the size of the foam article 300 as a result of the auxetic conversion process. The shrinkage of the auxetic foam article 310 may be attributed to the cells of the foam article 300 partially collapsing during the pressurizing step shown in FIG. 7C. In some embodiments, the auxetic conversion process results in a material undergoing the auxetic conversion process, such as the foam article 300, having a negative Poisson's ratio. The auxetic conversion process may result in converting the foam article 300 into the auxetic foam article 310 having a Poisson's ratio of less than 0 to approximately −1. For example, the auxetic conversion process may result in creating the auxetic foam article 310 having a Poisson's ratio between 0 and −1, −0.1 and −0.8, and −0.3 and −0.6.

Figure 8:
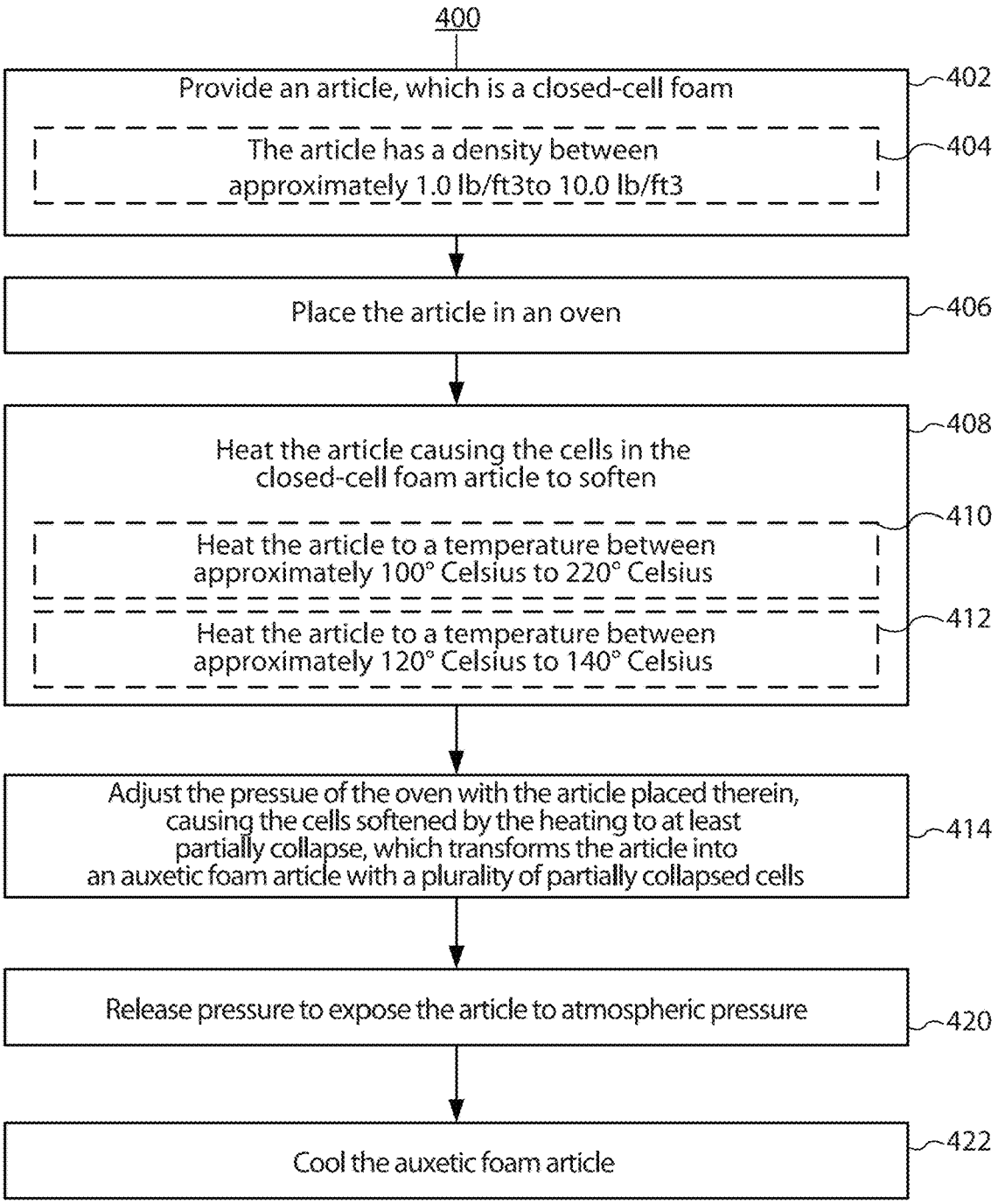
FIG. 8 is a flowchart showing a process for converting a foam article into an auxetic foam article in accordance with an exemplary embodiment.

Referring to FIG. 8, a flowchart showing a method 400 of converting a non-auxetic foam article into an auxetic foam article is illustrated. The foam article may be a polypropylene foam article, a polystyrene foam article, or any other type of foam article. For example, a polypropylene foam article may be converted into a polypropylene auxetic foam article. By way of another example, a polystyrene foam article may be converted into a polystyrene auxetic foam article. The non-auxetic foam article may be an example of the foam article 200/300, while the auxetic foam article may be an example of the auxetic foam article 210/310. As such, the auxetic foam article formed from the method 400 may be 0.5 inches thick and configured to maintain a peak acceleration below 150 G (preferably 130 G) when subjected to a localized impact (e.g., a localized impact of 25 J to 100 J). In some embodiments, the auxetic foam article formed from the method 400 may have a thickness between approximately 0.5 inches and 1 inch and may be configured to maintain a peak acceleration below 300 G when subjected to a localized impact.

The method 400 in step 402 includes providing a non-auxetic article that is a closed-cell foam. In some embodiments, the article is one of polypropylene or polystyrene. The foam article may have a density between approximately 1.0 lb/ft' to approximately 10.0 lb/ft$^3$ as indicated in step 404. In some instances, the article is referred to herein as an expanded polypropylene (EPP). In some other embodiments, the method 400 may include providing a polyethylene article that is a closed-cell foam, a polystyrene article that is a closed-cell foam, or other similar types of closed-cell foam articles. In some embodiments, the article provided is an isotropic material. In some other embodiments, the article provided is an anisotropic material. In some embodiments, the article provided has a thickness between 0.125 inches and 3 inches. The article provided may have various widths and lengths, such as at least 2 inches wide and at least 2 inches long. In some embodiments, step 404 includes step 404 and the non-auxetic article has a density between approximately 1.0 lb/ft$^3$ and 10.0 lb/ft$^3$.

The method 400 also includes step 406 of placing the article in an oven, such as oven 305, to prevent contact between the article and walls of the oven. The oven 305 may be a vacuum oven and/or a pressure vessel, such as an autoclave. For example, the oven 305 may be a pressure vessel configured to apply an elevated pressure and a pressure above atmospheric pressure. However, oven 305 may be configured to apply a negative pressure and a pressure below atmospheric pressure. In some embodiments, the article is suspended within the oven 305 by one or more points. For example, with reference to FIG. 7A, the article 300 is suspended away from the walls of the oven 305 by the hanger 307. In some other embodiments, the article may be suspended by other means, such as multiple hangers, hooks, strings, slip surfaces, particle beds, etc., or the article may be suspended in a liquid.

The method 400 includes step 408 of heating the article, such as article 300, for a first period of time. Stated differently, when placed in the oven 305 in step 406, the oven 305 is at an initial temperature, such as room temperature or a first desired temperature, as shown in FIG. 7A. In some embodiments, the oven 305 is maintained at a constant temperature. However, a temperature inside the oven 305 may be increased from the initial temperature to a second desired temperature and may be held at that second desired temperature for a period of time. The heating of the article at step 408 causes cells, such as cell 202 in FIG. 2, in the closed-cell foam of the article to soften. The first period of time may range from 5 minutes to 45 minutes. For example, the first period of time may be between 5 minutes and 45 minutes, 10 minutes and 40 minutes, 15 minutes and 35 minutes, or 20 minutes and 30 minutes. In preferred embodiments, the first period of time is between 10 minutes to 20 minutes. The first period of time is selected so that the material has a uniform internal temperature, which ensures that the cells collapse in a uniform fashion in step 414.

In some embodiments, step 408 of heating the oven 305 includes step 410 of heating the article placed within the oven 305 to a temperature between approximately 100° Celsius to approximately 220° Celsius, including all integer Celsius values and ranges there between. In some embodiments, heating the oven 305 in step 408 includes step 412 of heating the article placed within the oven to a temperature between approximately 120° Celsius to approximately 140° Celsius, including all integer Celsius values and ranges there between. In some embodiments, the polypropylene article has a softening temperature, which can be determined through experimentation before the steps of the method 400 shown in FIG. 8. In such instances, heating the oven 305 may involve heating the article to the softening temperature, and holding the article at its softening temperature for the predetermined period of time. In some embodiments, the article may be heated to a softening temperature between approximately 35° Celsius and 150° Celsius and may be held at the softening temperature for between approximately 5 minutes to 60 minutes.

The method 400 includes, after the first period of time has elapsed, step 414 of pressurizing the oven 305 containing the article placed therein for a second period of time, such as when air is evacuated from the oven 305. For example, the oven 305 may be under a vacuum and a pressure may be applied. In some embodiments, a pressure above atmospheric pressure is applied. However, a pressure below atmospheric pressure may be applied. During step 406 of placing the article within oven 305 and step 408 of heating, the article is subjected to an initial pressure as shown in FIGS. 7A and 7B. In some embodiments, the initial pressure is between approximately −14 PSI and approximately 0 PSI. After step 408 of heating, a pressure inside the oven 305 is adjusted, such as increased or decreased, from the initial pressure to a desired pressure and at step 414 is held at that desired pressure for a second period of time, as shown in FIG. 7C. In some embodiments, the desired pressure is between approximately −14 PSI and 200 PSI. The second period of time may range from 30 seconds to 30 minutes. However, the second period of time may be greater than 30 minutes. For example, the second period of time may be dependent on the size of the article and may be greater than 30 minutes for larger sizes of the article. In some embodiments, the second period of time is between 30 seconds and a sufficient amount of time for the article to reach a homogenous temperature throughout the entirety of the article. The second period of time may be between 30 seconds and 60 minutes, between 1 minute and 55 minutes, between 5 minutes and 40 minutes, or between 10 minutes and 30 minutes. In preferred embodiments, the second period of time is between 2 minutes and 7 minutes. The pressurizing at step 414 may cause cells to collapse by the heating at step 408. For example, the heating at step 408 may result in the gas at least partially escaping from the cells, which transforms the article into an auxetic foam article with a plurality of partially collapsed cells, such as the partially collapsed cells 212 in FIGS. 2B and 3B-3C.

In some embodiments, step 414 of pressurizing the oven 305 includes subjecting the article placed within the oven 305 to a vacuum pressure between approximately 16 kPa to approximately 100 kPa, including all integer pressure values and ranges there between. In some embodiments, step 414 of pressurizing the oven 305 includes subjecting the article placed within the oven 305 to a vacuum pressure between approximately 50 kPa to approximately 95 kPa, including all integer pressure values and ranges there between. In some embodiments, step 414 of pressurizing the oven 305 includes subjecting the article placed within the oven 305 to a vacuum pressure between approximately 80 kPa to approximately 88 kPa, including all integer pressure values and ranges there between. In some embodiments, step 414 of pressurizing the oven 305 includes subjecting the article placed within the oven 305 to a pressure between 10 kPa and 1000 kPa. For example, the article contained within in oven 305 may be pressurized to between 10 kPa and 1000 kPa, 50 kPa and 900 kPa, 150 kPa and 800 kPa, 250 kPa and 750 kPa, or 350 kPa and 700 kPa. In some embodiments, the oven 305 is pressurized to a pressure multiple times atmospheric pressure. In some embodiments, step 414 of pressurizing the oven 305 includes subjecting the article placed within the oven 305 to a vacuum pressure, while heating the oven 305 includes subjecting the article placed within the oven 305 to an elevated temperature. In some embodiments, a magnitude of the pressure may be inversely related to a magnitude of the elevated temperature. For example, an increase in the pressure may result in a decrease of the temperature within the oven 305. However, an increase in the pressure may result in an increase in temperature within the oven 305.

The method 400 further includes step 420 which occurs after the second period of time has elapsed. Step 420 may include ceasing pressurization of the oven 305 or adjusting the pressure to a pressure above atmospheric. For example, step 420 may include releasing a vacuum applied to oven 305. The method 400 also includes step 422 of cooling the auxetic foam article placed within the oven 305 for a third period of time. The third period of time may range from 5 seconds to 50 minutes. However, the third period of time may be greater than 50 minutes. For example, the third period of time may be dependent on the size of the article and may be greater than 50 minutes for larger sizes of the article. In some embodiments, the third period of time is between 5 seconds and a sufficient amount of time for the article to reach a homogenous temperature throughout the entirety of the article. For example, the third period of time may be between 5 seconds and 50 minutes, 30 seconds and 45 minutes, 1 minute and 40 minutes, 5 minutes and 35 minutes, 10 minutes and 30 minutes, or 15 minutes and 25 minutes. In preferred embodiments, the third period of time is between 25 minutes and 35 minutes. The cooling of step 422 may cause a structure of the plurality of partially collapsed cells of the auxetic foam article to become fixed. In some embodiments, releasing the vacuum of step 420 causes room temperature air to rush back into the oven 305, which provides a convective cooling effect. In some embodiments, step 420 is where the auxetic conversion of the article 300 occurs.

In some embodiments, step 422 of cooling the auxetic foam article involves exposing the auxetic foam article to a temperature below room temperature. Alternatively, step 422 of cooling the auxetic foam article may involve exposing the auxetic foam article to room temperature. The auxetic foam article may remain within the oven 305 during the cooling and may remain within the oven 305 during the heating at step 408 and the pressurizing at step 414. In some embodiments, the third period of time is reduced by subjecting the auxetic foam article to artificial cooling means, such as by fans, cooled air, liquid nitrogen bath, etc. In some embodiments, step 422 of cooling the auxetic foam article occurs before step 420 or simultaneously with step 420. For example, the auxetic foam article may be cooled prior to releasing the pressure.

In some embodiments, the foam article undergoes an isotropic auxetic conversion when transformed into the auxetic foam article due to the polypropylene foam article being placed within the oven 305. In embodiments where the foam article is an isotropic material, the auxetic conversion maintains the isotropic nature of the foam article in the auxetic foam article. In some embodiments, one or more tools/molds are attached to the foam article placed within the oven 305. The one or more tools/molds are used to impart a desired geometry to the auxetic foam article, such as the convex and/or concave geometries discussed above with reference to FIG. 1C.

Referring to FIGS. 7A-7C, the auxetic foam article created may have an increased resistance to localized impacts, relative to a resistance to localized impacts of the foam article. For example, the auxetic foam article, such as article 104 of FIG. 1A, produced by the method 400 may maintain a peak acceleration below 200 G, or preferably 150 G, when subjected to a localized impact (e.g., a localized impact of 25 J to 100 J). In some embodiments, the auxetic foam article 104-A is configured to dissipate a force from a localized impact such that a peak acceleration transferred to an object covered by the auxetic foam article 104-A, such as user's head wearing a helmet having the auxetic foam article 104-A disposed within, remains below 150 G, preferably 130 G. In this example, the localized impact contacts the helmet 100 at a location of the auxetic foam article 104-A. The other auxetic foam articles 104 discussed in FIGS. 1A-1C are designed to perform in the same fashion as the auxetic foam article 104-A.

The terminology used in the description of the invention herein is for the purpose of describing particular embodiments only and is not intended to be limiting of the invention. As used in the description of the invention and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Further, to the extent that the methods of the present invention do not rely on the particular order of steps set forth herein, the particular order of the steps should not be construed as limitation on the claims. Any claims directed to the methods of the present invention should not be limited to the performance of their steps in the order written, and one skilled in the art can readily appreciate that the steps may be varied and still remain within the spirit and scope of the present invention.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A helmet comprising:

an auxetic foam substrate having a top surface, a bottom surface opposite the top surface, and a thickness extending from the top surface to the bottom surface, the auxetic foam substrate comprised of a plurality of closed-cells and configured to dissipate forces delivered through the bottom surface associated with localized impacts delivered to the top surface of the auxetic foam substrate, the plurality of closed-cells each having a negative Poisson ratio; and a shell configured to receive a head of a user, the shell having an inner surface and an outer surface, wherein the auxetic foam substrate is disposed on the inner surface of the shell.

2. The helmet of claim 1, wherein the auxetic foam substrate is configured to increase in density, temporarily, in response to the localized impact being delivered to the outer surface of the shell.

3. The helmet of claim 1, wherein the auxetic foam substrate covers only a portion of the inner surface of the shell.

4. The helmet of claim 1, wherein the auxetic foam substrate substantially covers the inner surface of the shell.

5. The helmet of claim 1, wherein the auxetic foam substrate is configured to dissipate the forces associated with a predetermined localized impact delivered to the outer surface of the shell such that an amount of force transferred to the head of the user causes an acceleration of the head below 150G.

6. The helmet of claim 1, wherein:

a plurality of pads comprised of the auxetic foam substrate are distributed at multiple different locations on the inner surface of the shell; and the multiple different locations are selected based on locations of the head of the user that are vulnerable to localized impacts.

7. The helmet of claim 1 further comprising:

a padded layer comprised of a material disposed on the bottom surface of the auxetic foam substrate, the material of the padded layer being different than a material of the auxetic foam substrate; and a cover disposed over the padded layer and covering the padded layer and the auxetic foam substrate, wherein the auxetic foam substrate, the padded layer, and the cover form one or more impact absorbing pads.

8. The helmet of claim 7, wherein the one or more impact absorbing pads are:

(i) coupled to the inner surface of the shell;

(ii) approximately 2 inches or less thick, at least 2 inches long, and at least 2 inches wide; and (iii) configured to dissipate forces associated with localized impacts delivered to the outer surface of the shell such that a peak acceleration below 250G when the shell is subjected to localized impacts of at least 25 J.

9. The helmet of claim 8, wherein the auxetic foam substrate is configured to dissipate forces associated with localized impacts delivered to the outer surface of the shell such that a peak acceleration below 200G is maintained when the shell is subjected to localized impacts of at least 25 J.

10. The helmet of claim 8, wherein the auxetic foam substrate is configured to maintain a peak acceleration below 150G when the shell is subjected to localized impacts of at least 25 J.

11. The helmet of claim 1, wherein the top surface of the auxetic foam substrate is an uneven surface comprised of a plurality of concave portions.

12. The helmet of claim 1, wherein the thickness of the auxetic foam substrate is between approximately 0.2 inches and approximately 2 inches.

13. The helmet of claim 1, wherein the top surface of the auxetic foam substrate has a convex curvature and the bottom surface of the auxetic foam substrate has a concave curvature, the convex curvature of the top surface of the auxetic foam substrate and the concave curvature of the bottom surface of the auxetic foam substrate being set when the auxetic foam substrate is formed.

14. The helmet of claim 1, wherein the auxetic foam substrate is comprised of polypropylene.

15. The helmet of claim 1, wherein the auxetic foam substrate is comprised of polystyrene.

16. The helmet of claim 1, wherein a density of the auxetic foam substrate is between approximately 1.0 $lb/ft^3$ to approximately 10.0 $lb/ft^3$.

17. The helmet of claim 1, wherein the auxetic foam substrate is isotropic foam.

* * * * *